US010184165B2

(12) United States Patent
Kawamura et al.

(10) Patent No.: US 10,184,165 B2
(45) Date of Patent: Jan. 22, 2019

(54) HIGH STRENGTH AND HIGH TOUGHNESS MAGNESIUM ALLOY AND METHOD OF PRODUCING THE SAME

(71) Applicants: Yoshihito Kawamura, Kumamoto (JP); Michiaki Yamasaki, Kurokami (JP)

(72) Inventors: Yoshihito Kawamura, Kumamoto (JP); Michiaki Yamasaki, Kurokami (JP)

( * ) Notice: Subject to any disclaimer, the term of this patent is extended or adjusted under 35 U.S.C. 154(b) by 921 days.

(21) Appl. No.: 14/449,430

(22) Filed: Aug. 1, 2014

(65) Prior Publication Data

US 2015/0020931 A1 Jan. 22, 2015

Related U.S. Application Data

(62) Division of application No. 10/580,236, filed as application No. PCT/JP2004/017616 on Nov. 26, 2004, now abandoned.

(30) Foreign Application Priority Data

Nov. 26, 2003 (JP) ..... 2003-395905
Mar. 29, 2004 (JP) ..... 2004-096344
Sep. 30, 2004 (JP) ..... 2004-287912

(51) Int. Cl.
*C22F 1/06* (2006.01)
*C22C 23/04* (2006.01)
(Continued)

(52) U.S. Cl.
CPC ..... *C22F 1/06* (2013.01); *B21B 3/00* (2013.01); *B21C 23/002* (2013.01); *C22C 23/00* (2013.01);
(Continued)

(58) Field of Classification Search
CPC ..... C22F 1/06
See application file for complete search history.

(56) References Cited

U.S. PATENT DOCUMENTS 3,334,998 A 8/1967 Fisher
5,149,496 A * 9/1992 Das ..... C22C 49/04 419/17
(Continued)

FOREIGN PATENT DOCUMENTS

JP 05306424 11/1993
JP 2807374 7/1998
(Continued)

OTHER PUBLICATIONS

Inoue et al.. "Novel hexagonal structure and ultrahigh strength of magnesium solid solution in the Mg—Zn—Y system", J. Mater. Res., vol. 16, No. 7, Jul. 2001, p. 1894-1900 (Year: 2001).*
(Continued)

*Primary Examiner* — Devang R Patel
(74) *Attorney, Agent, or Firm* — Wenderoth, Lind & Ponack, L.L.P.

(57) ABSTRACT

A high strength and high toughness magnesium alloy, characterized in that it is a plastically worked product produced by a method comprising preparing a magnesium alloy cast product containing a atomic % of Zn, b atomic % of Y, a and b satisfying the following formulae (1) to (3), and the balance amount of Mg, subjecting the magnesium alloy cast product to a plastic working to form a preliminary plastically worked product, and subjecting the preliminary plastically worked product to a heat treatment, and it has a hcp structure magnesium phase and a long period stacking structure phase at an ordinary temperature; (1) $0.5 \leq a < 5.0$ (2) $0.5 < b < 5.0$ (3) $\frac{2}{3}a - \frac{5}{6} \leq b$.

7 Claims, 13 Drawing Sheets

(51) Int. Cl.

| | |
|---|---|
| ***C22C 23/06*** | (2006.01) |
| ***B21B 3/00*** | (2006.01) |
| ***B21C 23/00*** | (2006.01) |
| ***C22C 23/00*** | (2006.01) |

(52) U.S. Cl.
CPC ..... *C22C 23/04* (2013.01); *C22C 23/06* (2013.01); *Y10T 29/49988* (2015.01); *Y10T 29/49991* (2015.01)

(56) References Cited

U.S. PATENT DOCUMENTS

| | | | | |
|---|---|---|---|---|
| 5,167,917 | A * | 12/1992 | Sugitani | C22C 23/06 420/405 |
| 5,552,110 | A * | 9/1996 | Iba | C22C 23/04 420/405 |
| 6,143,097 | A * | 11/2000 | Fujita | B60B 3/06 148/420 |
| 6,471,797 | B1 | 10/2002 | Kim et al. | |
| 2003/0000608 | A1* | 1/2003 | Horie | C22C 23/04 148/666 |
| 2003/0029526 | A1 | 2/2003 | Kim et al. | |
| 2009/0263276 | A1* | 10/2009 | Pandey | C22C 21/00 420/542 |

FOREIGN PATENT DOCUMENTS

| | | |
|---|---|---|
| JP | 3238516 | 10/2001 |
| JP | 2002-256370 | 9/2002 |
| JP | 2002-309332 | 10/2002 |
| JP | 2003-96549 | 4/2003 |
| WO | 02/066696 | 8/2002 |

OTHER PUBLICATIONS

Hiroyuki Watanabe et al., "Mechanical Properties of Mg—Y—Zn Alloy Processed by Equal-Channel-Angular Extrusion", Materials Transactions, vol. 44, No. 4, pp. 463 to 467, 2003.

Supplementary European Search Report dated Jun. 5, 2008 in connection with European Application No. 04 81 9458 corresponding to the parent application of the present US Application.

Abe et al., "Long-period ordered structure in a high-strength nanocrystalline Mg-1 at% Zn-2 at% Y alloy studied by atomic-resolution Z-contrast STEM", Acta Materialia 50 (2002) 3845-3857, XP-002449191.

Watarai, "Trend of Research and Development for Magnesium Alloys—Reducing the Weight of Structural Materials in Motor Vehicles—", Science and Technology Trends, Quarterly Review No. 18, Jan. 2006, pp. 84-97, XP-002449192.

Morisaka et al., "Effects of Zn and RE on Structure and Mechanical Properties in Rapidly Solidified Mg—Zn—RE Alloys", Japan Institute of Light Metals Taikai Koen Gaiyo, XX, JP, vol. 104, Apr. 20, 2003, pp. 233-234, XP-002987595.

* cited by examiner $Mg_{96.5}Zn_1Y_1RE_{1.5}$ $Mg_{96.5}Zn_1Y_1Gd_{1.5}$ $Mg_{96.5}Zn_1Y_{1.5}RE_1$ $Mg_{96.5}Zn_1Y_{1.5}Gd_1$ REFERENCE
(Mg-Y binary alloy)

HIGH STRENGTH AND HIGH TOUGHNESS MAGNESIUM ALLOY AND METHOD OF PRODUCING THE SAME

FIELD OF THE INVENTION

The present invention relates to a high strength and high toughness magnesium alloy and a method of producing the same, more particularly, a high strength and high toughness magnesium alloy, in which the high strength and high toughness property can be achieved by containing a specific rare-earth element at a specific rate, and a method of producing the same.

BACKGROUND OF THE INVENTION

A magnesium alloy has come quickly into wide use as materials of a housing of a mobile-phone and a laptop computer or an automotive member because of its recyclability.

For these usages, the magnesium alloy is required to have a high strength and high toughness property. Thus, a producing method of a high strength and high toughness magnesium alloy has been studied in many ways from a material aspect and a manufacture aspect.

In a manufacture aspect, as a result of promoting nanocrystallizing, a rapid-solidified powder metallurgy method (a RS-P/M method) has been developed to obtain a magnesium alloy having a strength of about 400 MPa as much as about two times that of a casting material.

As a magnesium alloy, a Mg—Al based, a Mg—Al—Zn based, a Mg—Th—Zn based, a Mg—Th—Zn—Zr based, a Mg—Zn—Zr based, a Mg—Zn—Zr-RE (rare-earth element) based alloys are widely known. When a magnesium alloy having the aforesaid composition is produced by a casting method, a sufficient strength cannot be obtained. On the other hand, when a magnesium alloy having the aforesaid composition is produced by the RS-P/M method, a strength higher than that by the casting method can be obtained; however, the strength is still insufficient. Alternatively, the strength is sufficient while a toughness (a ductility) is insufficient. So, it is troublesome to use a magnesium alloy produced by the RS-P/M method for applications requiring a high strength and high toughness.

For a high strength and high toughness magnesium alloy, Mg—Zn-RE (rare-earth element) based alloys have been proposed (for instance, referring to Patent Literatures 1, 2 and 3).

Furthermore, an alloy containing Mg, 1 atomic % of Zn and 2 atomic % of Y, and an alloy containing Mg, 1 atomic % of Zn and 3 atomic % of Y, which is produced by a liquid quenching method, is disclosed in a Patent Literature 4. The alloy achieves to obtain a high strength property by making a fine-grained crystal structure by quenching.

Alternatively, a magnesium alloy, which is produced in such a manner that a casting product of an alloy containing Mg, 1 atomic % of Zn and 2 atomic % of Y is extruded at an extrusion rate of 4 and a temperature of 420° C. and then is subjected to a ECAE machining for 16 times, is disclosed in Non-Patent Literature 1. The idea of the Non-Patent Literature 1 is derived from the idea of the invention disclosed in Patent Literature 4, in which a fine-grained crystal structure is formed by quenching in order to obtain a high strength property. So, in this Non-Patent Literature, an ECAE machining for 16 times is carried out in order to form a fine-grained crystal structure.

Patent Literature 1: U.S. Pat. No. 3,238,516 (FIG. 1),
Patent Literature 2: U.S. Pat. No. 2,807,374,
Patent Literature 3: Japanese patent Application Laid Open 2002-256370 (Claims and Embodiments),
Patent Literature 4: WO02/066696 (PCT/JP01/00533),
Non Patent Literature 1: Material Transactions, Vol. 44, No. 4 (2003), pages 463 to 467.

DISCLOSURE OF INVENTION

Problems to be Resolved by the Invention

However, in a conventionally Mg—Zn-RE based material, a high strength magnesium alloy is obtained by, for instance, heat-treating an amorphous alloy material for forming a fine-grained structure. In this case, depending on a preconceived idea in which adding a substantial amount of zinc and rare-earth element is a requirement for obtaining the amorphous alloy material, a magnesium alloy containing relatively a large amount of zinc and rare-earth element has been used.

The Patent Literatures 1 and 2 disclose that a high strength and high toughness alloy can be obtained. However, practically, there are no alloys having enough strength and toughness for putting in practical use. And, currently, applications of a magnesium alloy have expanded, so an alloy having a conventionally strength and toughness is insufficient for such applications. Therefore, a higher strength and higher toughness magnesium alloy has been required.

The Non Patent Literature 1 has a problem in increasing producing cost because an ECAE working is carried out for 16 times after an extrusion process at an extrusion rate of 4. And, even, some time and effort to conduct, the ECAE working for 16 times is invested for adding a total amount of strain of 16 or more, the obtained alloy may have a yield strength of only 200 MPa order, showing insufficient strength.

The present invention has been conceived in view of the above problems. An object of the present invention is to provide a high strength and high toughness magnesium alloy having a strength and a toughness both being on a sufficient level for the alloy to be practically used for expanded applications of a magnesium alloy and a method of producing the same.

Means of Solving the Problems

In order to solve the above-mentioned problems, a high strength and high toughness magnesium alloy according to the present invention contains "a" atomic % of Zn, "b" atomic % of Y and a residue of Mg, wherein "a" and "b" satisfy the following expressions (1) to (3):

$$0.5 \leq a < 5.0; \quad (1)$$

$$0.5 < b < 5.0; \text{ and} \quad (2)$$

$$\tfrac{2}{3}a - \tfrac{5}{6} \leq b. \quad (3)$$

And, the high strength and high toughness magnesium alloy preferably comprises a plastically worked product which has a hcp structured magnesium phase and is produced by subjecting a magnesium alloy casting product to a plastic working.

A high strength and high toughness magnesium alloy according to the present invention preferably comprises a plastically worked product which is produced by preparing a magnesium alloy casting product containing "a" atomic % of Zn, "b" atomic % of Y and a residue of Mg, wherein "a"

and "b" satisfy the following expressions (1) to (3), and then subjecting the magnesium alloy casting product to a plastic working, wherein the plastically worked product has a hcp structured magnesium phase and a long period stacking ordered structure phase at room temperature:

$$0.5 \leq a < 5.0; \quad (1)$$

$$0.5 < b < 5.0; \text{ and} \quad (2)$$

$$\tfrac{2}{3}a - \tfrac{5}{6} \leq b. \quad (3)$$

A high strength and high toughness magnesium alloy according to the present invention preferably comprises a plastically worked product which is produced by preparing a magnesium alloy casting product containing "a" atomic % of Zn, "b" atomic % of Y and a residue of Mg, wherein "a" and "b" satisfy the following expressions (1) to (3), and then subjecting the magnesium alloy casting product to a plastic working and a heat treatment, wherein the plastically worked product has a hcp structured magnesium phase and a long period stacking ordered structure phase at room temperature:

$$0.5 \leq a < 5.0; \quad (1)$$

$$0.5 < b < 5.0; \text{ and} \quad (2)$$

$$\tfrac{2}{3}a - \tfrac{5}{6} \leq b. \quad (3)$$

And, in the high strength and high toughness magnesium alloy according to the present invention, the hcp structured magnesium phase preferably has an average particle size of 2 μm or more. And, the long period stacking ordered structure phase preferably has an average particle diameter of 0.2 μm or more and has a number of random grain boundaries existing in crystal grain thereof, in which the crystal grain defined by the random grain boundary preferably has an average particle size of 0.05 μm or more.

And, in the high strength and high toughness magnesium alloy according to the present invention, the long period stacking ordered structure phase preferably has at least single-digit smaller dislocation density than the hcp structured magnesium phase.

In the high strength and high toughness magnesium alloy according to the present invention, the long period stacking ordered structure phase preferably has a crystal grain having a volume fraction of 5% or more.

In the high strength and high toughness magnesium alloy according to the present invention, the plastically worked product may contain at least one kind of precipitation selected from the group consisting of a compound of Mg and rare-earth element, a compound of Mg and Zn, a compound of Zn and rare-earth element and a compound of Mg, Zn and rare-earth element.

In the high strength and high toughness magnesium alloy according to the present invention, the at least one kind of precipitation may have a total volume fraction of higher than 0 to 40% or less.

In the high strength and high toughness magnesium alloy according to the present invention, the plastic working is preferably carried out by at least one process in a rolling, an extrusion, an ECAE working, a drawing, a forging, a press, a form rolling, a bending, a FSW working and a cyclic working of theses workings.

In the high strength and high toughness magnesium alloy according to the present invention, a total strain amount when the plastic working is carried out is preferably 15 and below.

In the high strength and high toughness magnesium alloy according to the present invention, a total strain amount when the plastic working is carried out is more preferably 10 and below.

In the high strength and high toughness magnesium alloy according to the present invention, Mg may contain "c" atomic %, in a total amount, of at least one element selected from the group consisting of Yb, Tb, Sm and Nd, wherein "c" satisfies the following expressions (4) and (5):

$$0 \leq c \leq 3.0; \text{ and} \quad (4)$$

$$0.2 \leq b + c \leq 6.0. \quad (5)$$

In the high strength and high toughness magnesium alloy according to the present invention, Mg may contain "c" atomic %, in a total amount, of at least one element selected from the group consisting of La, Ce, Pr, Eu, Mm and Gd, wherein "c" satisfies the following expressions (4) and (5) or (5) and (6):

$$0 \leq c < 2.0; \quad (4)$$

$$0.2 \leq b + c \leq 6.0; \text{ and} \quad (5)$$

$$c/b \leq 1.5. \quad (6)$$

In the high strength and high toughness magnesium alloy according to the present invention, Mg may contain "c" atomic %, in a total amount, of at least one element selected from the group consisting of Yb, Tb, Sm and Nd and "d" atomic %, in a total amount, of at least one element selected from the group consisting of La, Ce, Pr, Eu, Mm and Gd, wherein "c" and "d" satisfy the following expressions (4) to (6) or (6) and (7):

$$0 \leq c \leq 3.0; \quad (4)$$

$$0 \leq d < 2.0; \quad (5)$$

$$0.2 \leq b + c + d \leq 6.0; \text{ and} \quad (6)$$

$$d/b \leq 1.5. \quad (7)$$

A high strength and high toughness magnesium alloy according to the present invention contains "a" atomic % of Zn, "b" atomic % of Y and a residue of Mg, wherein "a" and "b" satisfy the following expressions (1) to (3):

$$0.25 \leq a \leq 5.0; \quad (1)$$

$$0.5 \leq b \leq 0.5; \text{ and} \quad (2)$$

$$0.5a \leq b. \quad (3)$$

And, the high strength and high toughness magnesium alloy preferably comprises a plastically worked product which has a hcp structured magnesium phase and is produced by cutting a magnesium alloy casting product and then subjecting the cut magnesium alloy casting product to a plastic working.

A high strength and high toughness magnesium alloy according the present invention comprises a plastically worked product which is produced by preparing a magnesium alloy casting product containing "a" atomic % of Zn, "b" atomic % of Y and a residue of Mg, wherein "a" and "b" satisfy the following expressions (1) to (3), then cutting the magnesium alloy casting product to form a chip-shaped casting product and then solidifying the chip-shaped casting product by a plastic working, wherein the plastically worked product has a hcp structured magnesium phase and a long period stacking ordered structure phase at room temperature:

$$0.25 \leq a \leq 5.0; \quad (1)$$

$$0.5 \leq b \leq 5.0; \text{ and} \quad (2)$$

$$0.5a \leq b. \quad (3)$$

A high strength and high toughness magnesium alloy according to the present invention comprises a plastically worked product which is produced by preparing a magnesium alloy casting product containing "a" atomic % of Zn, "b" atomic % of Y and a residue of Mg, wherein "a" and "b" satisfy the following expressions (1) to (3), then cutting the magnesium alloy casting product to form a chip-shaped casting product, solidifying the chip-shaped casting product by a plastic working to form a plastically worked product and then subjecting the plastically worked product to a heat treatment, wherein the plastically worked product after subjecting to the heat treatment has a hcp structured magnesium phase and a long period stacking ordered structure phase at room temperature:

$$0.25 \leq a \leq 5.0; \quad (1)$$

$$0.5 \leq b \leq 5.0; \text{ and} \quad (2)$$

$$0.5a \leq b. \quad (3)$$

And, in the high strength and high toughness magnesium alloy according to the present invention, the hcp structured magnesium phase preferably has an average particle size of 0.1 μm or more. A forming material produced by solidifying chip-shaped materials has a particle diameter smaller than that of a casting material.

And, in the high strength and high toughness magnesium alloy according to the present invention, the long period stacking ordered structure phase preferably has at least single-digit smaller dislocation density than the hcp structured magnesium phase.

In the high strength and high toughness magnesium alloy according to the present invention, the long period stacking ordered structure phase preferably has a crystal grain having a volume fraction of 5% or more.

In the high strength and high toughness magnesium alloy according to the present invention, the plastically worked product may contain at least one kind of precipitation selected from the group consisting of a compound of Mg and rare-earth element, a compound of Mg and Zn, a compound of Zn and rare-earth element and a compound of Mg, Zn and rare-earth element.

In the high strength and high toughness magnesium alloy according to the present invention, the at least one kind of precipitation preferably has a total volume fraction of higher than 0 to 40% or less.

In the high strength and high toughness magnesium alloy according to the present invention, the plastic working is preferably carried out by at least one process in a rolling, an extrusion, an ECAE working, a drawing, a forging, a press, a form rolling, a bending, a FSW working and a cyclic working of theses workings.

In the high strength and high toughness magnesium alloy according to the present invention, a total strain amount when the plastic working is carried out is preferably 15 or less.

In the high strength and high toughness magnesium alloy according to the present invention, a total strain amount when the plastic working is carried out is more preferably 10 or less.

In the high strength and high toughness magnesium alloy according to the present invention, Mg may contain "c" atomic %, in a total amount, of at least one element selected from the group consisting of Yb, Tb, Sm and Nd, wherein "c" satisfies the following expressions (4) and (5):

$$0 \leq c \leq 3.0; \text{ and} \quad (4)$$

$$0.1 \leq b+c \leq 6.0. \quad (5)$$

In the high strength and high toughness magnesium alloy according to the present invention, Mg may contain "c" atomic %, in a total amount, of at least one element selected from the group consisting of La, Ce, Pr, Eu, Mm and Gd, wherein "c" satisfies the following expressions (4) and (5):

$$0 \leq c \leq 3.0; \text{ and} \quad (4)$$

$$0.1 \leq b+c \leq 6.0. \quad (5)$$

In the high strength and high toughness magnesium alloy according to the present invention, Mg may contain "c" atomic %, in a total amount, of at least one element selected from the group consisting of Yb, Tb, Sm and Nd and "d" atomic %, in a total amount, of at least one element selected from the group consisting of La, Ce, Pr, Eu, Mm and Gd, wherein "c" and "d" satisfy the following expressions (4) to (6), $$0 \leq c \leq 3.0, \quad (4)$$

$$0 \leq d \leq 3.0 \text{ and} \quad (5)$$

$$0.1 \leq b+c+d \leq 6.0. \quad (6)$$

In the high strength and high toughness magnesium alloy according to the present invention, Mg may contain larger than 0 atomic % to 2.5 atomic % or less, in a total amount, of at least one element selected from the group consisting of Al, Th, Ca, Si, Mn, Zr, Ti, Hf, Nb, Ag, Sr, Sc, B, C, Sn, Au, Ba, Ge, Bi, Ga, In, Ir, Li, Pd, Sb and V.

A method of producing a high strength and high toughness magnesium alloy according to the present invention comprises:

a step for preparing a magnesium alloy casting product containing "a" atomic % of Zn, "b" atomic % of Y and a residue of Mg, wherein "a" and "b" satisfy the following expressions (1) to (3); and a step for producing a plastically worked product by subjecting the magnesium alloy casting product to a plastic working:

$$0.5 \leq a < 5.0; \quad (1)$$

$$0.5 < b < 5.0; \text{ and} \quad (2)$$

$$\tfrac{2}{3}a - \tfrac{5}{6} \leq b. \quad (3)$$

In the method of producing a high strength and high toughness magnesium alloy according to the present invention, the magnesium alloy casting product preferably has a hcp structured magnesium phase and a long period stacking ordered structure phase.

According to the method of producing a high strength and high toughness magnesium alloy of the present invention, the plastic working for the magnesium alloy casting product can improve hardness and yield strength of the plastically worked product after the plastic working as compared with the casting product before the plastic working.

And, the method of producing a high strength and high toughness magnesium alloy according to the present invention preferably may comprise a step for subjecting the magnesium alloy casting product to a homogenized heat treatment between the step for preparing the magnesium alloy casting product and the step for producing the plastically worked product. In this case, the homogenized heat treatment is preferably carried out under a condition of a temperature of 400° C. to 550° C. and a treating period of 1 minute to 1500 minutes.

In addition, the method of producing a high strength and high toughness magnesium alloy according to the present invention may further comprise a step for subjecting the plastically worked product to a heat treatment after the step for producing the plastically worked product. In this case, the heat treatment is preferably carried out under a condition of a temperature of 150° C. to 450° C. and a treating period of 1 minute to 1500 minutes.

In the method of producing a high strength and high toughness magnesium alloy according to the present invention, Mg may contain "c" atomic %, in a total amount, of at least one element selected from the group consisting of Yb, Tb, Sm and Nd, wherein "c" satisfies the following expressions (4) and (5):

$$0 \leq c \leq 3.0; \text{ and} \quad (4)$$

$$0.2 \leq b+c \leq 6.0. \quad (5)$$

In the method of producing a high strength and high toughness magnesium alloy according to the present invention, Mg may contains "c" atomic %, in a total amount, of at least one element selected from the group consisting of La, Ce, Pr, Eu, Mm and Gd, wherein "c" satisfies the following expressions (4) and (5) or (5) and (6):

$$0 \leq c < 2.0; \quad (4)$$

$$0.2 \leq b+c \leq 6.0; \text{ and} \quad (5)$$

$$c/b \leq 1.5. \quad (6)$$

In the method of producing a high strength and high toughness magnesium alloy according to the present invention, Mg may contain "c" atomic %, in a total amount, of at least one element selected from the group consisting of Yb, Tb, Sm and Nd and "d" atomic %, in a total amount, of at least one element selected from the group consisting of La, Ce, Pr, Eu, Mm and Gd, wherein "c" and "d" satisfy the following expressions (4) to (6) or (6) and (7):

$$0 \leq c \leq 3.0; \quad (4)$$

$$0 \leq d < 2.0; \quad (5)$$

$$0.2 \leq b+c+d \leq 6.0; \text{ and} \quad (6)$$

$$d/b \leq 1.5. \quad (7)$$

A method of producing a high strength and high toughness magnesium alloy according to the present invention comprises:

a step for preparing a magnesium alloy casting product containing "a" atomic % of Zn, "b" atomic % of Y and a residue of Mg, wherein "a" and "b" satisfy the following expressions (1) to (3);

a step for producing a chip-shaped casting product by cutting the magnesium alloy casting product; and a step for producing a plastically worked product by solidifying the chip-shaped casting product by a plastic working:

$$0.25 \leq a \leq 5.0; \quad (1)$$

$$0.5 \leq b \leq 5.0; \text{ and} \quad (2)$$

$$0.5a \leq b \quad (3)$$

In the method of producing a high strength and high toughness magnesium alloy according to the present invention, the magnesium alloy casting product preferably has a hcp structured magnesium phase and a long period stacking ordered structure phase.

In the method of producing a high strength and high toughness magnesium alloy according to the present invention, Mg may contain atomic %, in a total amount, of at least one element selected from the group consisting of Yb, Tb, Sm and Nd, wherein "c" satisfies the following expressions (4) and (5):

$$0 \leq c \leq 3.0; \text{ and} \quad (4)$$

$$0.1 \leq b+c \leq 6.0. \quad (5)$$

In the method of producing a high strength and high toughness magnesium alloy according to the present invention, Mg may contain "c" atomic %, in a total amount, of at least one element selected from the group consisting of La, Ce, Pr, Eu, Mm and Gd, wherein "c" satisfies the following expressions (4) and (5):

$$0 \leq c \leq 3.0; \text{ and} \quad (4)$$

$$0.1 \leq b+c \leq 6.0. \quad (5)$$

In the method of producing a high strength and high toughness magnesium alloy according to the present invention, Mg may contain "c" atomic %, in a total amount, of at least one element selected from the group consisting of Yb, Tb, Sm and Nd and "d" atomic %, in a total amount, of at least one element selected from the group consisting of La, Ce, Pr, Eu, Mm and Gd, wherein "c" and "d" satisfy the following expressions (4) to (6):

$$0 \leq c \leq 3.0; \quad (4)$$

$$0 \leq d \leq 3.0; \text{ and} \quad (5)$$

$$0.1 \leq b+c+d \leq 6.0. \quad (6)$$

In the method of producing a high strength and high toughness magnesium alloy according to the present invention, Mg may contain larger than 0 atomic % to 2.5 atomic % or less, in a total amount, of at least one element selected from the group consisting of Al, Th, Ca, Si, Mn, Zr, Ti, Hf, Nb, Ag, Sr, Sc, B, C, Sn, Au, Ba, Ge, Bi, Ga, In, Ir, Li, Pd, Sb and V.

In the method of producing a the high strength and high toughness magnesium alloy according to the present invention, the plastic working may be carried out by at least one process in a rolling, an extrusion, an ECAE working, a drawing, a forging, a press, a form rolling, a bending, a FSW working and a cyclic working of theses workings. In other words, the plastic working may be carried out by one process or in combinations of these processes.

In the method of producing a high strength and high toughness magnesium alloy according to the present invention, a total strain amount when the plastic working is carried out is preferably 15 or less, more preferably, 10 or less. And, a strain amount per one of the plastic working is preferably 0.002 to 4.6.

The total strain amount means a total strain amount which is not canceled by a heat treatment such as annealing. In other words, a strain amount which is canceled by a heat treatment during a producing procedure is not contained in the total strain amount.

However, in a case of a high strength and high toughness magnesium alloy produced by a step for producing a chip-shaped casting product, the total strain amount means a total strain amount when a plastic working is carried out after producing a product prepared for a final solidifying-forming. So, a strain amount generated before producing a product prepared to a final solidifying-forming is not contained in the total strain amount. The product prepared to the final solidifying-forming is a product having less bonding strength of chips and having a tensile strength of 200 MPa and below. The solidifying-forming of the chip-shaped casting product is carried out by any process of an extrusion, a rolling, a forging, a press, an ECAE working and the like. After the solidifying-forming, a rolling, an extrusion, an ECAE working, a drawing, a forging, a press, a form rolling, a bending and a FSW working may be applied. And, before the final solidifying-forming, the chip-shaped casting product may be subjected to various plastic working such as a ball milling, a cyclic forming and a stamping milling.

The method of producing a high strength and high toughness magnesium alloy according to the present invention may further comprise a step for heat-treating the plastically worked product after the step for producing the plastically worked product. As a result, the plastically worked product can be improved in hardness and yield strength compared with the product before the heat treatment.

In the method of producing a high strength and high toughness magnesium alloy according to the present invention, the heat treatment is preferably carried out under a condition of a temperature of 200° C. to lower than 500° C. and a treating period of 10 minutes to shorter than 24 hours.

And, in the method of producing a high strength and high toughness magnesium alloy according to the present invention, the magnesium alloy after subjecting to the plastic working has a hcp structured phase preferably having single-digit larger dislocation density than a long period stacking ordered structure magnesium phase.

Effect of the Invention

As mentioned above, the present invention can provide a high strength and high toughness magnesium alloy having a strength and a toughness both being on a sufficient level for an alloy to be practically used for expanded applications of a magnesium alloy.

DETAILED DESCRIPTION OF EMBODIMENT OF THE INVENTION

Hereinafter, preferred embodiments of the present invention will be described.

The inventors, back to basics, have studied a strength and a toughness of a binary magnesium alloy at the first step. Then, the study is expanded to a multi-element magnesium alloy. As a result, it is found that a magnesium alloy having a sufficient strength and toughness property is a Mg—Zn—Y based magnesium alloy. In addition, it is also found that when a magnesium alloy contains Zn and Y in a small amount as 5.0 atomic % or less, respectively, unlike in conventional technique, a nonconventional high strength and high toughness property can be obtained.

Furthermore, it is found that subjecting a casting alloy, which forms a long period stacking ordered structure phase, to a plastic working or to a heat treatment after a plastic working can provide a high strength, high ductile and high toughness magnesium alloy. In addition, an alloy composition capable of forming a long period stacking ordered structure and providing a high strength, high ductile and high toughness property by subjecting to a plastic working or to a heat treatment after a plastic working can be also found.

Beside, it is also found that by producing a chip-shaped casting product by cutting a casting alloy, which forms a long period stacking ordered structure, and then subjecting the chip-shaped casting product to a plastic working or a heat treating after a plastic working, a higher strength, higher ductile and higher toughness magnesium alloy can be obtained as compared with a case not containing the step for cutting into a chip-shaped casting product. And, an alloy composition can be found, which can form a long period stacking ordered structure and provide a high strength, high ductile and high toughness property after subjecting a chip-shaped casting product to a plastic working or to a heat treatment after a plastic working.

A plastic working for a metal having a long period stacking ordered structure phase allows flexing or bending at least a part of the long period stacking ordered structure phase. As a result, a high strength, high ductile and high toughness metal can be obtained.

The flexed or bent long period stacking ordered structure phase has a random grain boundary. It is thought that the random grain boundary strengthens a magnesium alloy and suppresses a grain boundary sliding, resulting in obtaining a high strength property at high temperatures.

And, it is probable that a high density dislocation of a hcp structured magnesium phase strengthens a magnesium alloy; while a small density dislocation of a long period stacking ordered structure phase improves ductility and strength of the magnesium alloy. And, the long period stacking ordered structure phase preferably has at least single-digit smaller dislocation density than the hcp structured magnesium phase.

Embodiment 1

A magnesium alloy according to the first embodiment of the present invention is a ternary or more alloy essentially containing Mg, Zn and Y.

A composition range of the Mg—Zn—Y alloy according to the embodiment is shown in FIG. 8 at a range bounded by a line of H-I-C-D-E-H. When a content of Zn is set to "a" atomic % and a content of Y is set to "b" atomic %, "a" and "b" satisfy the following expressions (1) to (3):

$$0.5 \le a < 5.0; \quad (1)$$

$$0.5 < b < 5.0; \text{ and} \quad (2)$$

$$\tfrac{2}{3}a - \tfrac{5}{6} \le b. \quad (3)$$

A preferable composition range of the Mg—Zn—Y alloy according to the embodiment is shown in FIG. 8 at a range bounded by a line of F-G-C-D-E-F. When a content of Zn is set to "a" atomic % and a content of Y is set to "b" atomic %, "a" and "b" satisfy the following expressions (1) to (4):

$$0.5 \le a < 5.0; \quad (1)$$

$$0.5 < b < 5.0; \quad (2)$$

$$\tfrac{2}{3}a - \tfrac{5}{6} \le b; \text{ and} \quad (3)$$

$$0.75 \le b. \quad (4)$$

A more preferable composition range of the Mg—Zn—Y alloy according to the embodiment is shown in FIG. 8 at a range bounded by a line of A-B-C-D-E-A. When a content of Zn is set to "a" atomic % and a content of Y is set to "b" atomic %, and "b" satisfy the following expressions (1) to (3):

$$0.5 \leq a \leq 5.0; \quad (1)$$

$$1.0 \leq b \leq 5.0; \text{ and} \quad (2)$$

$$0.5a \leq b. \quad (3)$$

When a content of Zn exceeds 5 atomic %, a toughness (or a ductility) tends to be decreased particularly. And, when a total content of Y exceeds 5 atomic %, a toughness (or a ductility) tends to be decreased particularly.

When a content of Zn is less than 0.5 atomic % or a content of Y is less than 1.0 atomic %, at least either one of strength or toughness deteriorates. Accordingly, a lower limit of a content of Zn is set to 0.5 atomic % and a lower limit of a content of Y is set to 1.0 atomic %.

When a content of Zn is 0.5 to 1.5 atomic %, a strength and a toughness are remarkably increased. In a case of a content of Zn of near 0.5 atomic %, although a strength tends to decrease when a content of rare-earth element decreases, the strength and the toughness can be maintained at a higher level than that of a conventional alloy. Accordingly, in a magnesium alloy according to the embodiment, a content of Zn is set to a maximum range within 0.5 atomic % to 5.0 atomic %.

In a Mg—Zn—Y based magnesium alloy according to the present invention, a residue other than Zn and the rare-earth element within the aforesaid amount range is magnesium; however, the magnesium alloy may contain impurities of such a content that characteristic of the alloy is not influenced.

Embodiment 2

A magnesium alloy according to the second embodiment of the present invention is a quaternary alloy or more alloy essentially containing Mg, Zn and Y, and the forth element is one or two or more elements selected from the group consisting of Yb, Tb, Sm and Nd.

In a composition range of the Mg—Zn—Y alloy according to the embodiment, when a content of Zn is set to "a" atomic %, a content of Y is set to "b" atomic % and a total content of one or two or more forth elements is set to "c" atomic %, "a", "b" and "c" satisfy the following expressions (1) to (5):

$$0.5 \leq a < 5.0; \quad (1)$$

$$0.5 < b < 5.0; \quad (2)$$

$$\tfrac{2}{3}a - \tfrac{5}{6} \leq b; \quad (3)$$

$$0 \leq c \leq 3.0; \text{ and} \quad (4)$$

$$0.2 \leq b + c \leq 6.0. \quad (5)$$

In a preferably composition range of the Mg—Zn—Y alloy according to the embodiment, when a content of Zn is set to "a" atomic %, a content of Y is set to "b" atomic % and a total content of one or two or more forth elements is set to "c" atomic %, "a", "b" and "c" satisfy the following expressions (1) to (6):

$$0.5 \leq a < 5.0; \quad (1)$$

$$0.5 < b < 5.0; \quad (2)$$

$$\tfrac{2}{3}a - \tfrac{5}{6} \leq b; \quad (3)$$

$$0.75 \leq b; \quad (4)$$

$$0 \leq c \leq 3.0; \text{ and} \quad (5)$$

$$0.2 \leq b + c \leq 6.0. \quad (6)$$

In a more preferably composition range of the Mg—Zn—Y alloy according to the embodiment, when a content of Zn is set to "a" atomic %, a content of Y is set to "b" atomic % and a total content of one or two or more forth elements is set to "c" atomic %, "a", "b" and "c" satisfy the following expressions (1) to (5):

$$0.5 \leq a \leq 5.0; \quad (1)$$

$$1.0 \leq b \leq 5.0; \quad (2)$$

$$0.5a \leq b; \quad (3)$$

$$0 \leq c \leq 3.0; \text{ and} \quad (4)$$

$$0.2 \leq b + c \leq 6.0. \quad (5)$$

Causes for setting a content of Zn to 5 atomic % or less, setting a content of Y to 5 atomic % or less, setting a content of Zn to 0.5 atomic % or more and setting a content of Y to 1.0 atomic % or more are the same as the Embodiment 1. In this embodiment, an upper limit of a content of the forth element is set to 3.0 atomic % because the forth element has a small solid solubility limit. And, the reason for containing the forth element is because of effects for forming a fine-grained structure and for precipitating an intermetallic compound.

The Mg—Zn—Y base magnesium alloy according to the embodiment may contain impurities of such a content that characteristic of the alloy is not influenced.

Embodiment 3

A magnesium alloy according to the third embodiment of the present invention is a quaternary alloy or more alloy essentially containing Mg, Zn and Y, and the forth element is one or two or more elements selected from the group consisting of La, Ce, Pr, Eu, Mm and Gd. Mm (misch metal) is a mixture or an alloy of a number of rare-earth elements consisting of Ce and La mainly, and is a residue generated by refining and removing useful rare-earth element, such as Sm and Nd, from mineral ore. Its composition depends on a composition of the mineral ore before the refining.

In a composition range of the Mg—Zn—Y alloy according to the embodiment, when a content of Zn is set to "a" atomic %, a content of Y is set to "b" atomic % and a total content of one or two or more forth element is set to "c" atomic %, "a", "b" and "c" satisfy the following expressions (1) to (5), or, (1) to (3), (5) and (6):

$$0.5 \leq a < 5.0; \quad (1)$$

$$0.5 < b < 5.0; \quad (2)$$

$$\tfrac{2}{3}a - \tfrac{5}{6} \leq b; \quad (3)$$

$$0 \leq c < 2.0; \quad (4)$$

$$0.2 \leq b + c \leq 6.0; \text{ and} \quad (5)$$

$$c/b \leq 1.5. \quad (6)$$

In a preferable composition range of the Mg—Zn—Y alloy according to the embodiment, when a content of Zn is set to "a" atomic %, a content of Y is set to "b" atomic % and a total content of one or two or more forth elements is set to "c" atomic %, "a", "b" and "c" satisfy the following expressions (1) to (6), or, (1) to (4), (6) and (7):

$$0.5 \leq a < 5.0; \quad (1)$$

$$0.5 < b < 5.0; \quad (2)$$

$$2/3a - 5/6 \leq b; \quad (3)$$

$$0.75 \leq b; \quad (4)$$

$$0 \leq c < 2.0; \quad (5)$$

$$0.2 \leq b + c \leq 6.0; \text{ and} \quad (6)$$

$$c/b \leq 1.5. \quad (7)$$

In a more preferable composition range of the Mg—Zn—Y alloy according to the embodiment, when a content of Zn is set to "a" atomic %, a content of Y is set to "b" atomic % and a total content of one or two or more forth elements is set to "c" atomic %, "a", "b" and "c" satisfy the following expressions (1) to (5), or, (1) to (3), (5) and (6):

$$0.5 \leq a \leq 5.0; \quad (1)$$

$$1.0 \leq b \leq 5.0; \quad (2)$$

$$0.5a \leq b; \quad (3)$$

$$0 \leq c < 2.0; \quad (4)$$

$$0.2 \leq b + c \leq 6.0; \text{ and} \quad (5)$$

$$c/b \leq 1.5. \quad (6)$$

The expression (6) is defined because an effect for forming a long period stacking ordered structure phase is weakened if c/b is larger than 1.5 and the magnesium alloy increases in weight.

Causes for setting a content of Zn to 5 atomic % or less, setting a total content of one or two or more rare-earth elements to 5 atomic % or less, setting a content of Zn to 0.5 atomic % or more and setting a total content of one or two or more rare-earth elements to 1.0 atomic % or more are the same as the Embodiment 1. In this embodiment, an upper limit of a content of the forth element is set to 2.0 atomic % because the forth element has a small solid solubility limit. And, the reason for containing the forth element is because of effects for forming a fine-grained structure and for precipitating an intermetallic compound.

The Mg—Zn—Y base magnesium alloy according to the embodiment may contain impurities of such a content that characteristic of the alloy is not influenced.

Embodiment 4

A magnesium alloy according to the forth embodiment of the present invention is a quintet alloy or more alloy essentially containing Mg, Zn and Y, and the forth element is one or two or more elements selected from the group consisting of Yb, Tb, Sm and Nd and the fifth element is one or two or more elements selected from the group consisting of La, Ce, Pr, Eu, Mm and Gd.

In a composition range of Mg—Zn—Y alloy according to the embodiment, when a content of Zn is set to "a" atomic %, a content of Y is set to "b" atomic %, a total content of one or two or more forth elements is set to "c" atomic % and a total content of one or two or more of fifth elements is set to "d" atomic %, "a", "b", "c" and "d" satisfy the following expressions (1) to (6), or, (1) to (3), (6) and (7):

$$0.5 \leq a < 5.0; \quad (1)$$

$$0.5 < b < 5.0; \quad (2)$$

$$2/3a - 5/6 \leq b; \quad (3)$$

$$0 \leq c \leq 3.0; \quad (4)$$

$$0 \leq d < 2.0; \quad (5)$$

$$0.2 \leq b + c + d \leq 6.0; \text{ and} \quad (6)$$

$$d/b \leq 1.5. \quad (7)$$

In a preferable composition range of the Mg—Zn—Y alloy according to the embodiment, when a content of Zn is set to "a" atomic %, a content of Y is set to "b" atomic %, a total content of one or two or more forth elements is set to "c" atomic % and a total content of one or two or more of fifth elements is set to "d" atomic %, "a", "b", "c" and "d" satisfy the following expressions (1) to (7), or, (1) to (3), (7) and (8):

$$0.5 \leq a < 5.0; \quad (1)$$

$$0.5 < b < 5.0; \quad (2)$$

$$2/3a - 5/6 \leq b; \quad (3)$$

$$0.75 \leq b; \quad (4)$$

$$0 \leq c \leq 3.0; \quad (5)$$

$$0 \leq d < 2.0; \quad (6)$$

$$0.2 \leq b + c + d \leq 6.0; \text{ and} \quad (7)$$

$$d/b \leq 1.5. \quad (8)$$

In a more preferable composition range of the Mg—Zn—Y alloy according to the embodiment, when a content of Zn is set to "a" atomic %, a content of Y is set to "b" atomic %, a total content of one or two or more forth elements is set to "c" atomic % and a total content of one or two or more of fifth elements is set to "d" atomic %, "a", "b", "c" and "d" satisfy the following expressions (1) to (6), or, (1) to (3), (6) and (7):

$$0.5 \leq a \leq 5.0; \quad (1)$$

$$1.0 \leq b \leq 5.0; \quad (2)$$

$$0.5a \leq b; \quad (3)$$

$$0 \leq c \leq 3.0; \quad (4)$$

$$0 \leq d < 2.0; \quad (5)$$

$$0.2 \leq b + c + d \leq 6.0; \text{ and} \quad (6)$$

$$d/b \leq 1.5. \quad (7)$$

The expression (7) is defined because an effect for forming a long period stacking ordered structure phase is weakened if c/b is larger than 1.5 and the magnesium alloy increases in weight.

In this embodiment, the reason that a total content of Zn, Y, the forth element and the fifth element is set to 6.0 atomic % or less is because of increasing in weight and manufacturing cost and decreasing toughness if the content exceeds 6.0 atomic %. And, the reason that a content of Zn is set to 0.5 atomic % or more and a total amount of Y, the forth element and the fifth element is set to 1.0 atomic % or more is because a strength deteriorates if concentration of these elements are low. And, the reason for containing the forth and fifth elements is because of effects for forming a fine-grained structure and for precipitating an intermetallic compound.

The Mg—Zn—Y base magnesium alloy according to the embodiment may contain impurities at a content that characteristic of the alloy is not influenced.

Embodiment 5

A magnesium alloy according to the fifth embodiment of the present invention is a magnesium alloy having any compositions of the magnesium alloys described in the Embodiments 1 to 4 to which Me is added. Me is at least one element selected from the group consisting of Al, Th, Ca, Si, Mn, Zr, Ti, Hf, Nb, Ag, Sr, Sc, B, C, Sn, Au, Ba, Ge, Bi, Ga, In, Ir, Li, Pd, Sb and V. A content of Me is set to larger than 0 atomic % to 2.5 atomic % or less. An addition of Me can improve characteristics other than the strength and the toughness which are being kept high. For instance, a corrosion resistance and an effect for forming a fine-grained crystal structure are improved.

Embodiment 6

A method of producing a magnesium alloy according to the sixth embodiment of the present invention will be described.

A magnesium alloy having any one composition in the magnesium alloys according to the Embodiments 1 to 5 was melted and cast to prepare a magnesium alloy casting product. A cooling rate at the casting was 1000K/sec or less, more preferably 100K/sec or less. The casting process may employ various process, such as a high-pressure cast process, a roll cast process, a tilting cast process, a continuous cast process, a thixocasting process, a die casting process and the like. And, the magnesium alloy casting product may be cut into a specified shape for employing.

Next, the magnesium alloy casting product may be subjected to a homogenized heat treatment. In this case, a heating temperature is preferably 400° C. to 550° C. and a treating period is preferably 1 minute to 1500 minutes (or 24 hours).

Then, the magnesium alloy casting product was plastically worked. As the plastic working method, an extrusion, an ECAE (Equal Channel Angular Extrusion) working method, a rolling, a drawing, a forging, a press, a form rolling, a bending, a FAW (Friction Stir Welding) working, a cyclic process thereof and the like may be employed.

When the plastic working method is an extrusion, an extrusion temperature is preferably set to 250° C. to 500° C. and a reduction rate of a cross section due to the extrusion is preferably set to be 5% or more.

The ECAE working is carried out such that a sample is rotated every 90° in the length direction thereof every pass for introducing a strain therein uniformly. Specifically, a forming die having a forming pore of a L-shaped cross section is employed, and the magnesium alloy casting product as a forming material is forcibly poured in the forming pore. And, the magnesium alloy casting product is applied with stress at a portion at which the L-shaped forming pore is curved at 90° thereby to obtain a compact excellent in strength and toughness. A number of passes of the ECAE working is preferably set to 1 to 8, more preferably, 3 to 5. A temperature of the ECAE working is preferably set to 250° C. to 500° C.

When the plastic working method is an extrusion, an extrusion temperature is preferably set to 250° C. to 500° C. and a rolling reduction is preferably set to 5% or more.

When the plastic working method is a drawing, drawing temperature is preferably set to 250° C. to 500° C. and a reduction rate of a cross section is preferably set to 5% or more.

When the plastic working method is a forging, a forging temperature is preferably set to 250° C. to 500° C. and a processing rate is preferably set to 5% or more.

The plastic working for the magnesium alloy casting product is carried out such that an amount of strain per one working is preferably 0.002 to 4.6 and a total amount of strain is preferably 15 or less. More preferably, an amount of strain per one working is 0.002 to 4.6 and a total amount of strain is 10 or less. The reason that a total amount of strain is set to 15 or less, preferably 10 or less, is because a strength of a magnesium alloy does not increase with increasing the total strain amount and the manufacturing cost increases with increasing the total strain amount.

In the ECAE working, an amount of strain per one working is 0.95 to 1.15. So, when the ECAE working is carried out for 16 times, a total amount of strain is added up to 15.2 (0.95×16). When the ECAE working is carried out for 8 times, a total amount of strain is added up to 7.6 (0.95×16).

In the extrusion, an amount of strain per one working is 0.92; 1.39; 2.30; 2.995; 3.91; 4.61 and 6.90 in a case of an extrusion rate of 2.5; 4; 10; 20; 50; 100 and 1000.

The aforesaid plastically worked product produced by subjecting the magnesium alloy casting product to a plastic working has a crystal structure of a hcp structured magnesium phase and a long period stacking ordered structure phase at room temperatures. And, the long period stacking ordered structure has a crystal grain having a volume fraction of 5% or more (preferably, 10% or more). And, the hcp structured magnesium phase has an average particle diameter of 2 μm or more and the long period stacking ordered structure phase has an average particle diameter of 0.2 μm or more. The long period stacking ordered structure phase has a number of random grain boundaries contained in crystal grain thereof. And, the crystal grain defined by the grain boundary has an average particle diameter of 0.05 μm or more. Although a dislocation density is large at the random grain boundary, a dislocation density is small at portions other than the random grain boundary in the long period stacking ordered structure phase. Accordingly, the hcp structured magnesium phase has single-digit larger dislocation density than portions other than the grain boundaries of the long period stacking ordered structure phase.

At least a part of the long period stacking ordered structure phase is flexed or bend. And, the plastically worked product may contain at least one kind of precipitation selected from the group consisting of a compound of Mg and rare-earth element, a compound of Mg and Zn, a compound of Zn and rare-earth element and a compound of Mg, Zn and rare-earth element. The precipitation preferably has a total volume fraction of higher than 0 to 40% and below. The plastically worked product subjected to the plastic working is improved in Vickers hardness and yield strength as compared with the casting product before the plastic working.

The plastically worked product after subjecting to the plastic working may be subjected to a heat treatment. The heat treatment is preferably carried out at a temperature of 200° C. or more to lower than 500° C. and a treating period of 10 minutes to 1500 minutes (or 24 hours). The reason that the heating temperature is set to lower than 500° C. is that an amount of strain applied by the plastic working is canceled if the temperature is 500° C. or more.

The plastically worked product subjected to the heat treatment is improved in Vickers hardness and yield strength as compared with that before the heat treatment. The plastically worked product after the heat treatment, with as that before the heat treatment, has a crystal structure of a hcp structured magnesium phase and a long period stacking ordered structure phase at room temperatures. And, the long period stacking ordered structure has a crystal grain having a volume fraction of 5% or more (preferably 10% or more). And, the hcp structured magnesium phase has an average particle diameter of 2 μm or more and the long period stacking ordered structure phase has an average particle diameter of 0.2 μm or more. The long period stacking ordered structure phase has a number of random grain boundaries contained in crystal grain thereof. And, the crystal grain defined by the grain boundary has an average particle diameter of 0.05 μm or more. Although a dislocation density is large at the random grain boundaries, a dislocation density is small at portions other than the random grain boundary in the long period stacking ordered structure phase. Accordingly, a hcp structured magnesium phase has single-digit larger dislocation density than that of portions other than the grain boundaries of the long period stacking ordered structure phase.

At least a part of the long period stacking ordered structure phase is flexed or bend. And, the plastically worked product may contain at least one kind of precipitation selected from the group consisting of a compound of Mg and rare-earth element, a compound of Mg and Zn, a compound of Zn and rare-earth element and a compound of Mg, Zn and rare-earth element. The precipitation preferably has a total volume fraction of higher than 0 to 40% and below.

According to the Embodiments 1 to 6, a high strength and high toughness magnesium alloy having a strength and a toughness both being on a level for an alloy to be practically used for expanded applications of a magnesium alloy, for example, a high technology alloy requiring a high strength and toughness, and a method of producing the same can be provided.

Embodiment 7

A magnesium alloy according to the seventh embodiment is applied for a number of chip-shaped casting products each having a side length of several mm or less produced by cutting a casting product. The magnesium alloy is a ternary or more alloy essentially containing Mg, Zn and Y.

A composition range of the Mg—Zn—Y alloy according to the embodiment is shown in FIG. 9 at a range bounded by a line of A-B-C-D-E. When a content of Zn is set to "a" atomic % and a content of Y is set to "b" atomic %, "a" and "b" satisfy the following expressions (1) to (3):

$$0.25 \le a \le 5.0; \quad (1)$$

$$0.5 \le b \le 5.0; \text{ and} \quad (2)$$

$$0.5a \le b \quad (3)$$

When a content of Zn is more than 5 atomic %, a toughness (or a ductility) tends to decrease particularly. And, when a content of Y is more than 5 atomic %, a toughness (or a ductility) tends to decrease particularly.

And, when a content of Zn is less than 0.25 atomic % or a content of Y is less than 0.5 atomic %, either one of strength or toughness deteriorates. Accordingly, a lower limit of a content of Zn is set to 0.25 atomic % and a lower limit of a content of rare-earth element is set to 0.5 atomic %. The reason that each of the lower limits of the contents of Zn and rare-earth element can be decreased to a half of that of the first embodiment is for employing a chip-shaped casting product.

When a content of Zn is 0.5 to 1.5 atomic %, a strength and a toughness are remarkably increased. In a case of a content of Zn of near 0.5 atomic %, although a strength tends to decrease when a content of rare-earth element decreases, the strength and the toughness can be maintained at a higher level than that of a conventional alloy. Accordingly, in the magnesium alloy according to the embodiment, a content of Zn is set to a maximum range within 0.25 atomic % to 5.0 atomic %.

In the Mg—Zn-RE based magnesium alloy according to the present invention, a residue other than Zn and rare-earth element within the aforesaid range is magnesium; however, the magnesium alloy may contain impurities of such a content that characteristic of the alloy is not influenced.

Embodiment 8

A magnesium alloy according to the eight embodiment of the present invention is applied for a number of chip-shaped casting products having a side length of several mm or less produced by cutting a casting product. The magnesium alloy is a quaternary alloy or more alloy essentially containing Mg, Zn and Y, and the forth element is one or two or more elements selected from the group consisting of Yb, Tb, Sm and Nd.

In a composition range of the Mg—Zn—Y alloy according to the embodiment, when a content of Zn is set to "a" atomic %, a content of Y is set to "b" atomic % and a total content of one or two or more forth elements is set to atomic %, "a", "b" and "c" satisfy the following expressions (1) to (5):

$$0.25 \le a \le 5.0; \quad (1)$$

$$0.5 \le b \le 5.0; \quad (2)$$

$$0.5a \le b; \quad (3)$$

$$0 \le c \le 3.0; \text{ and} \quad (4)$$

$$0.1 \le b+c \le 6.0. \quad (5)$$

Causes for setting a content of Zn to 5 atomic % or less, setting a total content of one or two or more rare-earth elements to 5 atomic % or less, setting a content of Zn to 0.25 atomic % or more and setting a content of Y to 0.5 atomic % or more are the same as the Embodiment 7. In this embodiment, an upper limit of a content of the forth element is set to 3.0 atomic % because the forth element has a small solid solubility limit. And, the reason for containing the forth element is because of effects for forming a fine-grained structure and for precipitating an intermetallic compound.

The Mg—Zn-RE base magnesium alloy according to the embodiment may contain impurities of such a content that characteristic of the alloy is not influenced.

Embodiment 9

A magnesium alloy according to the ninth embodiment of the present invention is applied for a number of chip-shaped casting products having a side length of several mm or less produced by cutting a casting product. The magnesium alloy is a quaternary alloy or a quintet or more alloy essentially containing Mg, Zn and Y, and the forth element is one or two or more elements selected from the group consisting of La, Ce, Pr, Eu, Mm and Gr.

In a composition range of the Mg—Zn-RE alloy according to the embodiment, when a content of Zn is set to "a" atomic %, a content of Y is set to "b" atomic % and a total content of one or two or more forth elements is set to atomic %, "a", "b" and "c" satisfy the following expressions (1) to (5):

$$0.25 \leq a \leq 5.0; \quad (1)$$

$$0.5 \leq b \leq 5.0; \quad (2)$$

$$0.5a \leq b; \quad (3)$$

$$0 \leq c \leq 3.0; \text{ and} \quad (4)$$

$$0.1 \leq b+c \leq 6.0. \quad (5)$$

Causes for setting a content of Zn to 5 atomic % or less, setting a total content of one or more rare-earth elements to 5 atomic % or less, setting a content of Zn to 0.25 atomic % or more and setting a content of Y to 0.5 atomic % or more are the same as the Embodiment 7. In this embodiment, an upper limit of a content of the forth element is set to 2.0 atomic % because the forth element has a small solid solubility limit. And, the reason for containing the forth element is because of effects for forming a fine-grained structure and for precipitating an intermetallic compound.

The Mg—Zn-RE base magnesium alloy according to the embodiment may contain impurities of such a content that characteristic of the alloy is not influenced.

Embodiment 10

A magnesium alloy according to the tenth embodiment of the present invention is applied for a number of chip-shaped casting products having a side length of several mm or less produced by cutting a casting product. The magnesium is a quintet alloy or more alloy essentially containing Mg, Zn and Y, and the forth element is one or two or more elements selected from the group consisting of Yb, Tb, Sm and Gd and the fifth element is one or two or more elements selected from the group consisting of La, Ce, Pr, Eu and Mm.

In a composition range of the Mg—Zn—Y alloy according to the embodiment, when a content of Zn is set to "a" atomic %, a content of Y is set to "b" atomic %, a total content of one or two or more forth elements is set to "c" atomic % and a total content of one or two or more of fifth elements is set to "d" atomic %, "a", "b", "c" and "d" satisfy the following expressions (1) to (6):

$$0.25 \leq a \leq 5.0; \quad (1)$$

$$0.5 \leq b \leq 5.0; \quad (2)$$

$$0.5a \leq b; \quad (3)$$

$$0 \leq c \leq 3.0; \quad (4)$$

$$0 \leq d \leq 3.0; \text{ and} \quad (5)$$

$$0.1 \leq b+c+d \leq 6.0. \quad (6)$$

Causes for setting a total content of Zn, y, the forth element and the fifth element to less than 6.0 atomic % and setting a total content of Zn, Y, the forth element and the fifth element to higher than 1.0 atomic % are the same as the Embodiment 4.

The Mg—Zn-RE base magnesium alloy according to the embodiment may contain impurities of such a content that characteristic of the alloy is not influenced.

Embodiment 11

A magnesium alloy according to the eleventh embodiment of the present invention is a magnesium alloy having any composition of the magnesium alloys described in the Embodiments 7 to 11 to which Me is added. Me is at least one element selected from the group consisting of Al, Th, Ca, Si, Mn, Zr, Ti, Hf, Nb, Ag, Sr, Sc, B, C, Sn, Au, Ba, Ge, Bi, Ga, In, Ir, Li, Pd, Sb and V. A content of Me is set to larger than 0 atomic % to 2.5 atomic % or less. An addition of Me can improve characteristics other than the strength and the toughness which are being kept high. For instance, a corrosion resistance and an effect for forming fine-grained crystal structure are improved.

Embodiment 12

A method of producing a magnesium alloy according to the twelve embodiment of the present invention will be described.

A magnesium alloy having any composition in the magnesium alloys according to Embodiments 7 to 11 was melted and cast to prepare a magnesium alloy casting product. A cooling rate at the casting was 1000K/sec or less, more preferably 100K/sec or less. For the magnesium alloy casting product, products cut from ingot into a specified shape was employed.

Next, the magnesium alloy casting product may be subjected to a homogenized heat treatment. In this case, a heating temperature is preferably set to 400° C. to 550° C. and a treating period is preferably set to 1 minute to 1500 minutes (or 24 hours).

Then, the magnesium alloy casting product was cut into a number of chip-shaped casting products each having a side length of several mm or less.

And, the chip-shaped casting products may be preformed by a press or a plastic working method and then subjected to a homogenized heat treatment. In this case, a heating temperature is preferably set to 400° C. to 550° C. and a treating period is preferably set to 1 minute to 1500 minutes (or 24 hours). And, the preformed product may be subjected to a heat treatment under a condition of a temperature of 150° C. to 450° C. and a treating period of 1 minute to 1500 minutes (or 24 hours).

The chip-shaped casting products are usually employed as a material for thixocasting.

And, a mixture of the chip-shaped casting product and ceramic particles may be preformed by a press or a plastic working and then subjected to a homogenized heat treatment. And, before the performing of the chip-shaped casting products, a forced straining working may be carried out additionally.

Then, the chip-shaped casting products were plastically worked for solidifying-forming. For a method of the plastic working, various methods may be employed as with the Embodiment 6. And, before the solidifying-forming of the chip-shaped casting products, a cyclic working such as a mechanical alloying, such as a boll milling and a stamp milling, and a bulk mechanical alloying may be applied. And, after the solidifying-forming, a plastic working or a blast working may be further carried out. And, the magnesium alloy casting product may be combined with intermetallic compound particle, ceramic particle and fiber. And, the chip-shaped casting products may be mixed with ceramic particle and fiber.

The plastically worked product subjected to the plastic working has a crystal structure of a hcp structured magnesium phase and a long period stacking ordered structure phase at room temperatures. At least a part of the long period stacking ordered structure phase is flexed or bend. The plastically worked product subjected to the plastic working is improved in Vickers hardness and yield strength as compared with the casting product before the plastic working.

A total amount of strain when the chip-shaped casting products are subjected to a plastic working is preferably 15 or less, more preferably, 10 or less. And, an amount of strain per one working is preferably 0.002 to 4.6.

The total strain amount means a total strain amount which is not canceled by a heat treatment such as annealing. Thus, it means a total amount of strain generated when the plastic working is carried out after the performing the chip-shaped casting products. In other words, a strain amount which is canceled by a heat treatment during a producing procedure is not contained in the total amount. And, an amount of strain generated before performing the chip-shaped casting products is not contained in the total amount.

The plastically worked product after subjecting the chip-shaped casting product to the plastic working may be subjected to a heat treatment. The heat treatment is preferably carried out at a temperature of 200° C. or more to lower than 500° C. and a treating period of 10 minutes to 1500 minutes (or 24 hours). The reason for setting the heating temperature to lower than 500° C. is that an amount of strain applied by the plastic working is canceled if the temperature is 500° C. or more.

The plastically worked product subjected to the heat treatment is improved in Vickers hardness and yield strength as compared with that before the heat treatment. And, the plastically worked product subjected to the heat treatment, as with that before the heat treatment, has a crystal structure of a hcp structured magnesium phase and a long period stacking ordered structure phase at room temperatures. At least a part of the long period stacking ordered structure phase is flexed or bend.

According to the Embodiment 12, since a casting product is cut into chip-shaped casting products, a fine-grained structure crystal can be obtained. As a result, it becomes possible to produce a plastically worked product having a higher strength, a higher ductility and a higher toughness than that according to the Embodiment 6. In addition, a magnesium alloy according to the embodiment can have a high strength and a high toughness if densities of Zn and rare-earth element are lower than those of the magnesium alloys according to Embodiments 1 to 6.

According to Embodiments 7 to 12, a high strength and high toughness magnesium alloy having a strength and a toughness both being on a level for an alloy to be practically used for expanded applications of a magnesium alloy, for example, a high technology alloy requiring a high strength and toughness property, and a method of producing the same can be provided.

Example

Hereinafter, preferred examples of the present invention will be described.

In Example 1, a ternary alloy containing 97 atomic % of Mg, 1 atomic % of Zn and 2 atomic % of Y is employed.

In Example 2, a quaternary alloy containing 96.5 atomic % of Mg, 1 atomic % of Zn, 1 atomic % of Y and 1.5 atomic % of Gd is employed. The magnesium alloy according to Example 2 is an alloy to which rare-earth element, which forms a long period stacking ordered structure, and another rare-earth element, which does not form a long period stacking ordered structure, are added in combination.

In Example 3, a quaternary alloy containing 97.5 atomic % of Mg, 1 atomic % of Zn, 2 atomic % of Y and 0.5 atomic % of La is employed.

In Example 4, a quaternary alloy containing 97.5 atomic % of Mg, 0.5 atomic % of Zn, 1.5 atomic % of Y and 0.5 atomic % of Yb is employed.

Each of the magnesium alloys according to Examples 3 and 4 is an alloy to which a rare-earth element, which forms a long period stacking ordered structure, and another rare-earth element, which does not form a long period stacking ordered structure, are added in combination.

In Example 5, a quaternary alloy containing 96.5 atomic % of Mg, 1 atomic % of Zn, 1.5 atomic % of Y and 1 atomic % of Gd is employed.

In Example 6, a ternary alloy containing 96 atomic % of Mg, 1 atomic % of Zn and 3 atomic % of Y is employed.

In Comparative example 1, a ternary alloy containing 97 atomic % of Mg, 1 atomic % of Zn and 2 atomic % of La is employed.

In Comparative example 2, a ternary alloy containing 97 atomic % of Mg, 1 atomic % of Zn and 2 atomic % of Yb is employed.

In Comparative example 3, a ternary alloy containing 97 atomic % of Mg, 1 atomic % of Zn and 2 atomic % of Ce is employed.

In Comparative example 4, a ternary alloy containing 97 atomic % of Mg, 1 atomic % of Zn and 2 atomic % of Pr is employed.

In Comparative example 5, a ternary alloy containing 97 atomic % of Mg, 1 atomic % of Zn and 2 atomic % of Nd is employed.

In Comparative example 6, a ternary alloy containing 97 atomic % of Mg, 1 atomic % of Zn and 2 atomic % of Sm is employed.

In Comparative example 7, a ternary alloy containing 97 atomic % of Mg, 1 atomic % of Zn and 2 atomic % of Eu is employed.

In Comparative example 8, a ternary alloy containing 97 atomic % of Mg, 1 atomic % of Zn and 2 atomic % of Tm is employed.

In Comparative example 9, a ternary alloy containing 97 atomic % of Mg, 1 atomic % of Zn and 2 atomic % of Lu is employed.

For a reference example, a binary alloy containing 98 atomic % of Mg and 2 atomic % of Y is employed.

(Structure of Casting Material)

First, ingots having compositions according to Examples 1 to 6, Comparative examples 1 to 9 and the reference example were prepared by high frequency melting under an Ar gas environment. Then, a sample 10 mm in diameter and 60 mm in length was cut out from each of the ingots. And, a structure of each of the casting samples was observed using SEM and XRD. Photographs of the observed structures are shown in FIGS. 1 to 7.

Figure 1:
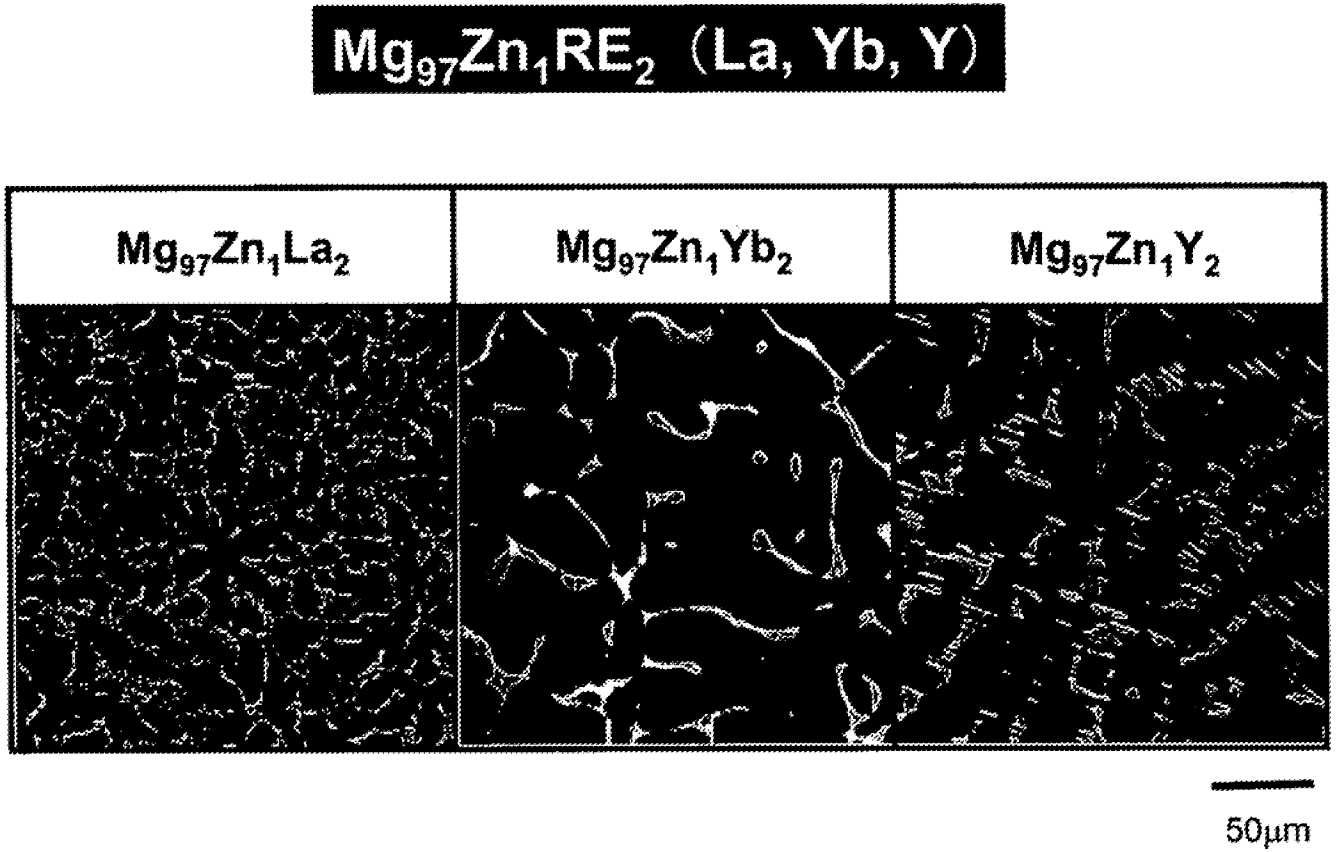
FIG. 1 is photographs showing crystal structures according to Example 1 and Comparative examples 1 and 2.
Figure 6:
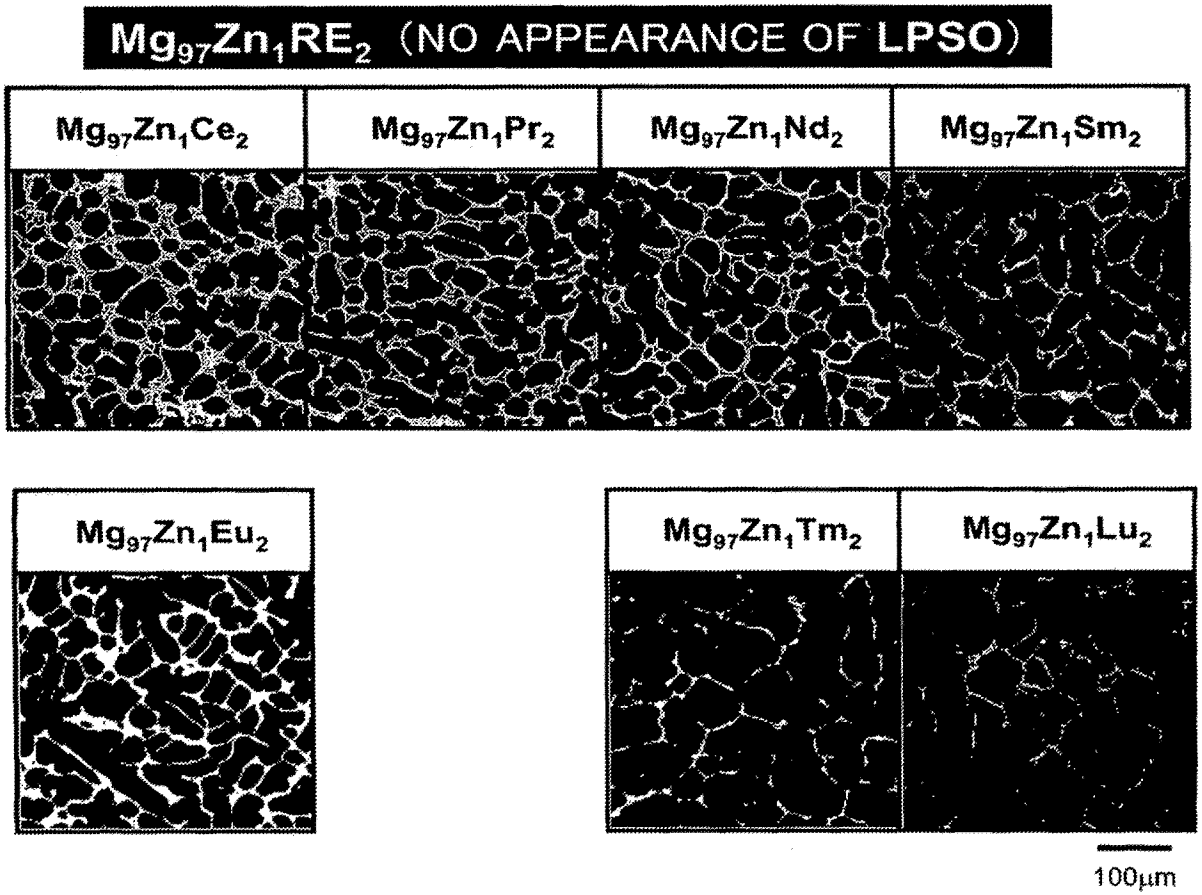
FIG. 6 is photographs showing crystal structures according to Comparative examples 3 to 9.
Figure 7:
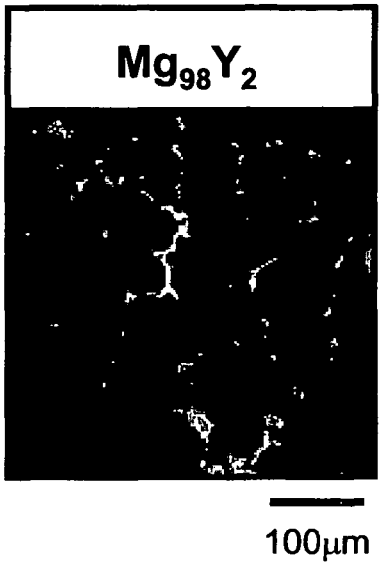
FIG. 7 is a photograph showing a crystal structure according to the reference example.

As shown in FIG. 1 and FIGS. 3 to 5, the magnesium alloys according to Examples 1 to 6 have a long period stacking ordered structure crystal formed therein. On the contrary, as shown in FIG. 1 and FIGS. 6 and 7, the magnesium alloys according to Comparative examples 1 to 9 and the reference example do not have a long period stacking ordered structure crystal formed therein.

From the observation of Examples 1 to 6 and Comparative examples 1 to 9, the following facts are confirmed.

In the Mg—Zn-RE ternary casting alloy, a long period stacking ordered structure is formed therein if RE is Y; however, it is not formed if RE is La, Ce, Pr, Nd, Sm, Eu, Gd and Yb. Gd is slightly different from La, Ce, Pr, Nd, Sm, Eu and Yb in behavior. So, although a long period stacking ordered structure is not formed if Gd is added alone (Zn is necessarily added), when Gd is added together with Y which is an element for forming a long period stacking ordered structure, a long period stacking ordered structure is formed if an addition amount is 2.5 atomic % (referring to Examples 2 and 5).

And, when each of Yb, Tb, Sm, Nd and Gd is added to a Mg—Zn—Y alloy at an addition amount of 5.0 atomic % or less, a formation of a long period stacking ordered structure is not inhibited. When each of La, Ce, Pr, Eu and Mm is added to a Mg—Zn—Y alloy at an addition amount of 5.0 atomic % or less, a formation of a long period stacking ordered structure is not inhibited.

The casting material according to Comparative example 1 has a particle diameter of about 10 to 30 μm, the casting material according to Comparative example 2 has a particle diameter of about 30 to 100 μm and the casting material according to Example 1 has a particle diameter of about 20 to 60 μm. From the observation of these casting materials, a large quantity of crystallization is formed at grain boundaries. And, from the observation of a crystal structure of the casting material according to Comparative example 2, fine precipitation is formed in its particle.

(Vickers Hardness of Casting Material)

Each of the casting materials according to Example and Comparative examples 1 and 2 was evaluated in Vickers hardness according to a Vickers hardness test. As a result, the casting material of Comparative example 1 has a Vickers hardness of 75 Hv, the casting material of Comparative example 2 has a Vickers hardness of 69 Hv and the casting material of Example 1 has a Vickers hardness of 79 Hv.

(ECAE Working)

Each of the casting materials of Example 1 and Comparative Examples 1 and 2 was subjected to an ECAE working at 400° C. The ECAE working was carried out such that the sample was rotated every 90° in the length direction thereof every pass for introducing strain therein uniformly. A number of the pass was 4 times and 8 times. And, a working rate was constant at 2 mm/sec.

(Vickers Hardness of ECAE Worked Material)

Each of the casting material subjected to the ECAE working was evaluated in Vickers hardness according to a Vickers hardness test. As a result of 4 times of the ECAE working, the casting material of Comparative Example 2 has a Vickers hardness of 76 Hv. On the contrary, the casting material of Example 1 has a Vickers hardness of 96 Hv. So, each of the casting material subjected to the ECAE working is improved in Vickers hardness to 10 to 20% higher than that before the ECAE working. The casting material subjected to the ECAE working for 8 times shows little difference in hardness from the casting material subjected to the ECAE working for 4 times.

(Crystal Structure of ECAE Worked Material)

Composition of each of the casting sample subjected to the ECAE working was observed using SEM and XRD. In the casting materials of Comparative examples 1 and 2, crystallization formed at grain boundaries is decoupled into order of several microns to be dispersed uniformly therein. On the contrary, in the casting materials of Example 1, crystallization formed at grain boundaries is not decoupled and is applied with shear while matrix and consistency being maintained. The casting material subjected to the ECAE working for 8 times shows little difference in structure from the casting material subjected to the ECAE working for 4 times.

(Tensile Strength of ECAE Worked Material)

The ECAE worked casting materials were evaluated in tensile strength according to a tensile strength test. The tensile strength test was carried out under an initial strain rate of $5\times10^{-4}$/sec in the parallel direction to a pushing direction. In a case of 4 times of the ECAE working, the casting materials according to Comparative examples 1 and 2 have a yield strength of 200 Mpa or lower and an expansion of 2 to 3%. On the contrary, the casting materials according to Example 1 have a yield strength of 260 Mpa and an expansion of 15%. This shows an excellent performance as compared with a casting material having a yield strength 100 MPa under proof stress of 0.2% and an expansion of 4%.

Figure 12:
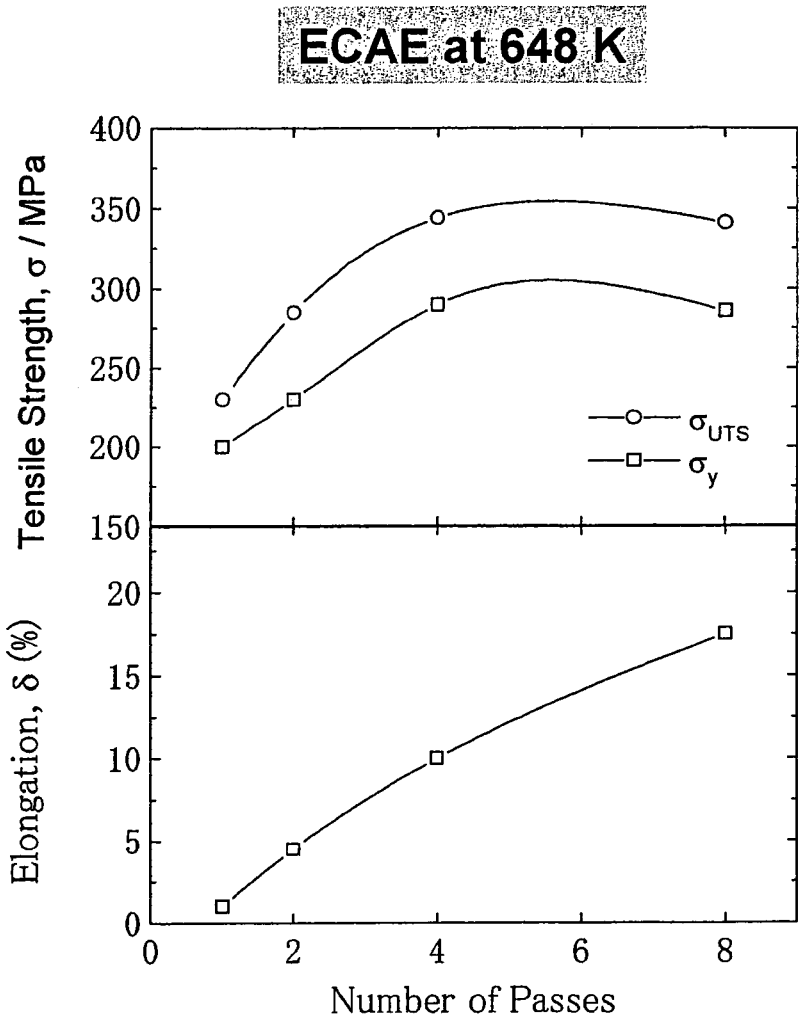

FIG. 12 is a graph showing a relationship of a number of pass of ECAE working, a yield strength (σy), a tensile strength ($\sigma_{UTS}$) and an expansion (%) when the casting material of Example 1 was subjected to the ECAE working at 375° C.

Figure 13:
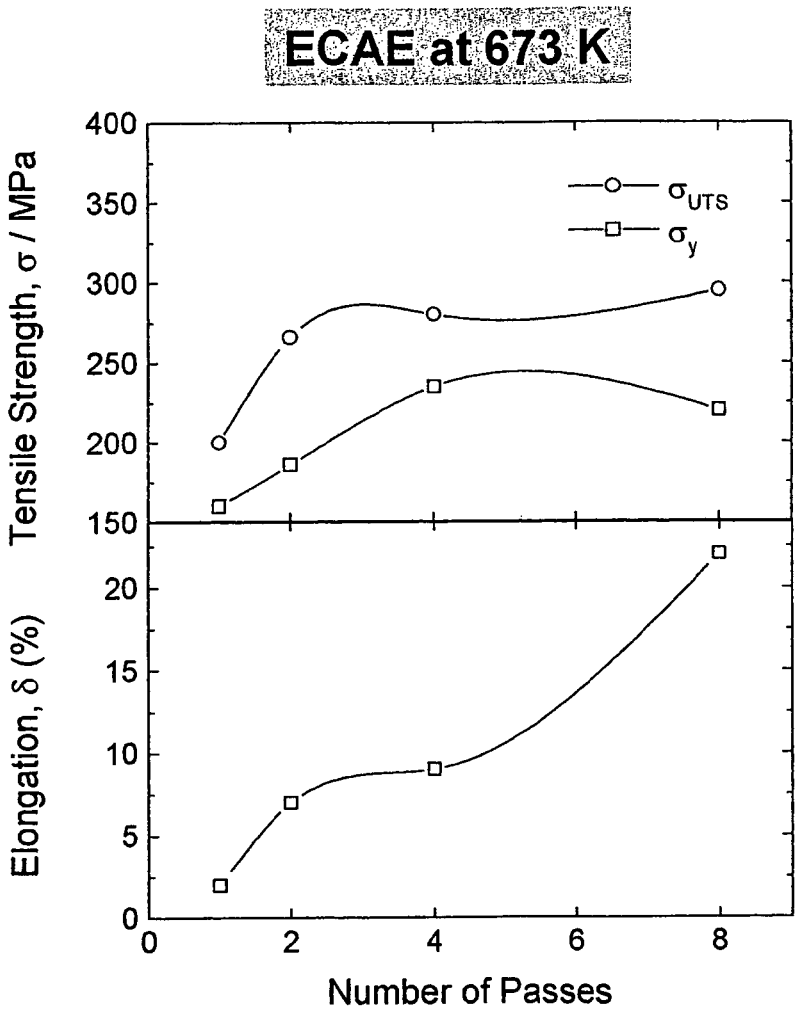

FIG. 13 is a graph showing a relationship of a number of pass of ECAE working, a yield strength (σy), a tensile strength ($\sigma_{UTS}$) and an expansion (%) when the casting material of Example 1 was subjected to the ECAE working at 400° C.

FIGS. 12 and 13 show that when the number of passes of the ECAE working increases in order to increase an amount of strain, the strength of the magnesium alloy does not increase.

(Heat Treatment of ECAE Worked Material)

The casting material subjected to the ECAE working for 4 times was maintained at a constant temperature of 225° C. and then a relation between the retention period and change in hardness was evaluated. As a result, in the casting material of Example 1, the heat treatment of 225° C. further improves hardness such that a yield strength according to a tensile test can increase to 300 MPa.

When a treating temperature of the ECAE working for the casting material of Example 1 decreases down to 375° C. (that is, when the casting material of Example 1 is subjected to the ECAE working for 4 times at a temperature of 375° C., not 400° C.), the ECAE worked product of Example 1 have a yield strength of 300 MPa and an expansion of 12%. And, a heat treatment of the ECAE worked casting material at 225° C. can improve a yield strength according to a tensile test up to 320 MPa.

(Extrusion of Casting Alloy of Example 6)

The casting alloy of Example 6 is a ternary alloy containing 96 atomic % of Mg, 1 atomic % of Zn and 3 atomic % of Y. which has a long period stacking ordered structure. The casting alloy was extruded at a condition of a temperature of 300° C., a cross section reduction rate of 90% and an extrusion speed of 2.5 mm/sec. The resultant extruded magnesium alloy has a yield strength of 420 MPa and an expansion of 2% at room temperatures.

(Property of Extruded Casting Alloys of Examples 6 to 42 and Comparative Examples 10 to 15)

Casting materials having compositions shown in Table 1 were prepared. And, the casting materials were extruded at an extrusion temperatures and an extrusion rates shown in Table 1. The extruded casting materials were evaluated in a 2% proof stress (a yield strength), a tensile strength and an expansion according to a tensile test at temperatures shown in Table 1. The measurements are shown in Table 1.

TABLE 1

MECHANICAL PROPERTIES OF Mg—Zn—Y BASED EXTRUDED ALLOY

| | COMPOSITION (at. %) | EXTRUSION TEMPERATURE(° C.) | EXTRUSION RATIO | TEMPERATURE(° C.) | 0.2% PROOF STRESS (MPa) | TENSILE STRENGTH (MPa) | EXPANSION(%) |
|---|---|---|---|---|---|---|---|
| EXAMPLE 7 | Mg—1Zn—2.5Y | 350 | 10 | ROOM TEMPERATURE | 339 | 403 | 8 |
| EXAMPLE 6 | Mg—1Zn—3Y | 350 | 10 | ROOM TEMPERATURE | 335 | 408 | 8 |
| EXAMPLE 8 | Mg—1Zn—3.5Y | 350 | 10 | ROOM TEMPERATURE | 356 | 430 | 7.5 |
| EXAMPLE 9 | Mg—1.5Zn—1.25Y | 350 | 10 | ROOM TEMPERATURE | 340 | 364 | 9 |
| EXAMPLE 10 | Mg—1.5Zn—2Y | 400 | 10 | ROOM TEMPERATURE | 365 | 396 | 5 |
| EXAMPLE 11 | Mg—2Zn—2Y | 350 | 10 | ROOM TEMPERATURE | 389 | 423 | 5 |
| EXAMPLE 12 | ↓ | 400 | 10 | ROOM TEMPERATURE | 326 | 361 | 4 |
| EXAMPLE 13 | Mg—2Zn—2Y—0.2Zr | 350 | 10 | ROOM TEMPERATURE | 405 | 465 | 8.5 |
| EXAMPLE 14 | ↓ | 400 | 10 | ROOM TEMPERATURE | 425 | 471 | 8.5 |
| EXAMPLE 15 | ↓ | 400 | 2.5 | ROOM TEMPERATURE | 345 | 406 | 4.87 |
| EXAMPLE 16 | ↓ | 450 | 2.5 | ROOM TEMPERATURE | 356 | 406 | 6.5 |
| EXAMPLE 17 | Mg—2Zn—2Y—2Al | 350 | 10 | ROOM TEMPERATURE | 366 | 380 | 8.5 |
| EXAMPLE 18 | Mg—2Zn—2Y—1.3Ca | 350 | 10 | ROOM TEMPERATURE | 411 | 450 | 3 |
| EXAMPLE 19 | Mg—2Zn—2Y—0.5Ag | 350 | 10 | ROOM TEMPERATURE | 388 | 438 | 9 |
| EXAMPLE 20 | Mg—2Zn—2Y—1Si | 350 | 10 | ROOM TEMPERATURE | 396 | 433 | 6.5 |
| EXAMPLE 21 | Mg—2Zn—3.5Y | 350 | 10 | ROOM TEMPERATURE | 360 | 446 | 9.5 |
| EXAMPLE 22 | Mg—2.5Zn—1.5Y | 350 | 10 | ROOM TEMPERATURE | 343 | 361 | 7 |
| EXAMPLE 23 | Mg—2.5Zn—2Y | 350 | 10 | ROOM TEMPERATURE | 385 | 415 | 3.7 |
| EXAMPLE 24 | ↓ | 400 | 10 | ROOM TEMPERATURE | 345 | 369 | 6 |
| EXAMPLE 25 | Mg—2.5Zn—3.5Y | 450 | 10 | ROOM TEMPERATURE | 360 | 442 | 9 |
| EXAMPLE 26 | Mg—2.5Zn—4Y | 450 | 10 | ROOM TEMPERATURE | 370 | 450 | 6 |
| EXAMPLE 27 | ↓ | 450 | 10 | 200 | 286 | 385 | 18.1 |
| EXAMPLE 28 | Mg—3Zn—3Y | 450 | 10 | ROOM TEMPERATURE | 430 | 487 | 7.5 |
| EXAMPLE 29 | ↓ | 450 | 10 | 200 | 287 | 351 | 21.1 |
| EXAMPLE 30 | Mg—3Zn—3.5Y | 450 | 10 | ROOM TEMPERATURE | 440 | 492 | 6 |
| EXAMPLE 31 | Mg—3.5Zn—3Y | 350 | 10 | ROOM TEMPERATURE | 425 | 490 | 7.5 |
| EXAMPLE 32 | Mg—3.5Zn—4.5Y | 350 | 10 | ROOM TEMPERATURE | 404 | 491 | 3.5 |
| EXAMPLE 33 | Mg—4.5Zn—3Y | 450 | 10 | ROOM TEMPERATURE | 342 | 363 | 7.5 |
| EXAMPLE 34 | Mg—1Zn—2Y | 350 | 2.5 | ROOM TEMPERATURE | 273 | 325 | 0.5 |
| EXAMPLE 35 | Mg—0.5Zn—2Y | 350 | 10 | ROOM TEMPERATURE | 310 | 350 | 6 |
| EXAMPLE 36 | ↓ | 400 | 10 | ROOM TEMPERATURE | 270 | 300 | 2 |

TABLE 1-continued

MECHANICAL PROPERTIES OF Mg—Zn—Y BASED EXTRUDED ALLOY

| | COMPOSITION (at. %) | EXTRUSION TEMPERATURE(° C.) | EXTRUSION RATIO | TEMPERATURE(° C.) | 0.2% PROOF STRESS (MPa) | TENSILE STRENGTH (MPa) | EXPANSION(%) |
|---|---|---|---|---|---|---|---|
| EXAMPLE 37 | ↓ | 400 | 10 | ROOM TEMPERATURE | 365 | 396 | 5 |
| EXAMPLE 38 | Mg—1Zn—1Y | 350 | 10 | ROOM TEMPERATURE | 360 | 390 | 2 |
| EXAMPLE 39 | ↓ | ↓ | 10 | ROOM TEMPERATURE | 373 | 384 | 4 |
| EXAMPLE 40 | Mg—1Zn—1.5Y | 350 | 10 | ROOM TEMPERATURE | 367 | 380 | 1.3 |
| EXAMPLE 41 | Mg—1Zn—2Y | 350 | 10 | ROOM TEMPERATURE | 375 | 420 | 4 |
| EXAMPLE 42 | ↓ | 400 | 10 | ROOM TEMPERATURE | 330 | 385 | 7 |
| COMPARATIVE EXAMPLE 10 | Mg—2Zn—2Y | 350 | 1 | ROOM TEMPERATURE | 80 | 104 | 1.5 |
| COMPARATIVE EXAMPLE 11 | Mg—4Zn—1Y | 400 | 10 | ROOM TEMPERATURE | 260 | 325 | 9.8 |
| COMPARATIVE EXAMPLE 12 | Mg—1Zn—0.5Y | 350 | 10 | ROOM TEMPERATURE | 320 | 340 | 0.5 |
| COMPARATIVE EXAMPLE 13 | PURE Mg | 350 | 10 | ROOM TEMPERATURE | | 45 | 35 |
| COMPARATIVE EXAMPLE 14 | Mg—1Zn | 350 | 10 | ROOM TEMPERATURE | | 67 | 50 |
| COMPARATIVE EXAMPLE 15 | Mg—2Y | 350 | 10 | ROOM TEMPERATURE | | 210 | 15 |

Table 1 shows results of the tensile test at room temperatures of the Mg—Zn—Y alloy casting materials prepared by changing addition amounts of Z and Y, to which an extrusion was subjected at a temperature and a extrusion rate shown in Table 1 and at an extrusion speed of 2.5 mm/sec.

Figure 11:
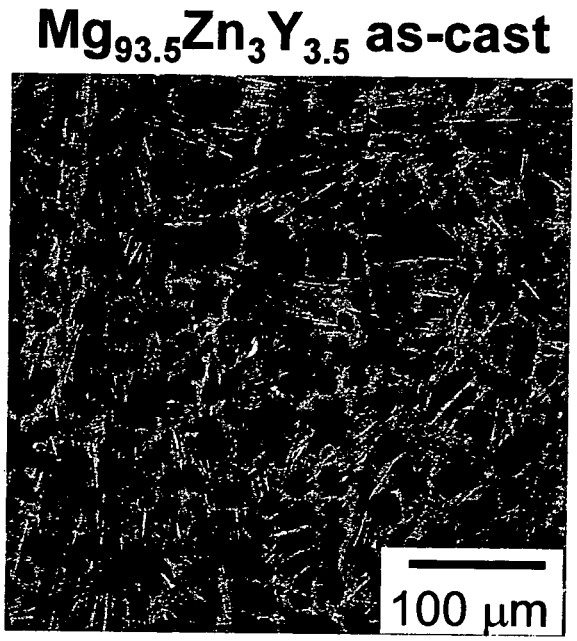

FIG. 11 is a photograph showing a crystal structure of a casting material of a magnesium alloy having composition of Example 30.

From the results of Example 17 to 20, adding the forth element can improve strength or expansion, or both of strength and expansion, as compared with the ternary alloy.

From a viewpoint for putting a high strength and high toughness magnesium alloy in practical use, a magnesium alloy having small expansion and sufficient strength is applicable for use; a magnesium alloy having small strength and sufficient expansion is also applicable for use. So, when a yield strength (MPa) is set to S and an expansion (%) is set to d, a magnesium alloy satisfying the following expressions (1) and (2) is preferred from practical application:

$$S>-15d+435 \quad (1),$$

$$S\geq 325 \quad (2)$$

Figure 2:
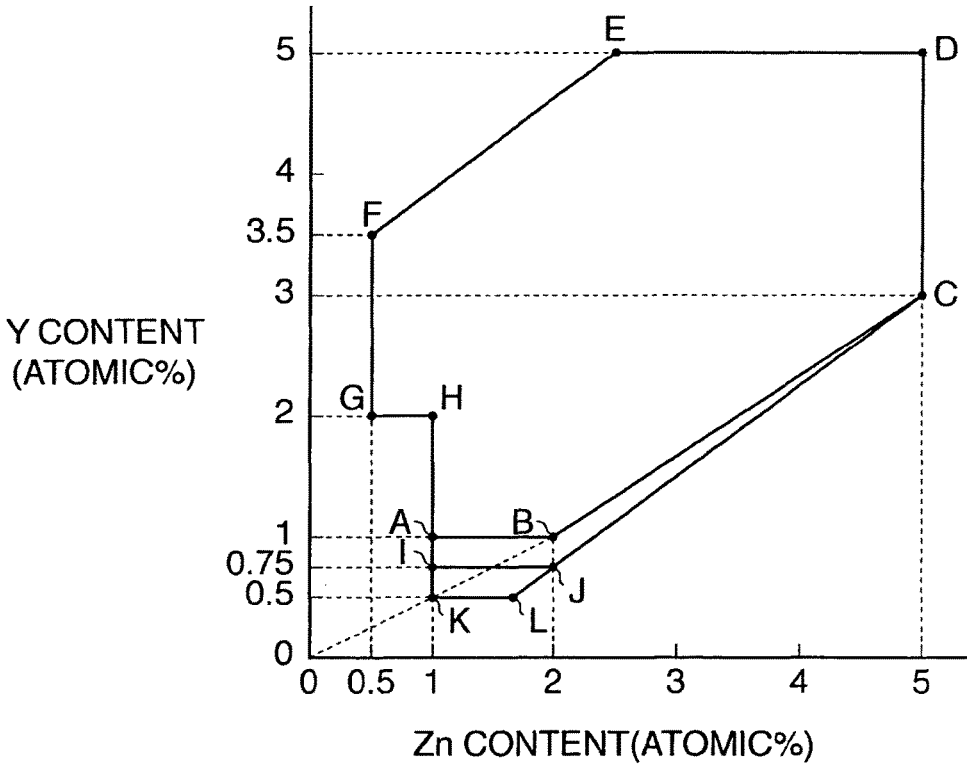

From the measurement of Table 1, a composition range of a Mg—Zn—Y alloy satisfying the expressions (1) and (2) is shown in FIG. 2.

A composition range of a Mg—Zn—Y alloy satisfying the expressions (1) and (2) is a range bounded by a line of K-L-C-D-E-F-G-H-K without on a line of G-H-K-L-C-D-E-F in FIG. 2.

A preferable composition range of a Mg—Zn—Y alloy satisfying the expressions (1) and (2) is a range bounded by a line of I-J-C-D-E-F-G-H-I without on a line of G-H-I-J-C-D-E-F in FIG. 2.

A more preferable composition range of a Mg—Zn—Y alloy satisfying the expressions (1) and (2) is a range bounded by a line of A-B-C-D-E-F-G-H-A without on a line of G-H-A-B-C-D-E-F.

In FIG. 2, a point I shows 1 atomic % of Zn and 0.75 atomic % of Y, a point K shows 1 atomic % of Zn and 0.5 atomic % of Y, a point K shows 1 atomic % of Zn and 0.5 atomic % of Y, a point L shows 5/3 atomic % of Zn and 0.5 atomic % of Y, a point J shows 2 atomic % of Zn and 0.75 atomic % of Y, a point C shows 5 atomic % of Zn and 3 atomic % of Y, a point D shows 5 atomic % of Zn and 5 atomic % of Y, a point E shows 2.5 atomic % of Zn and 5 atomic % of Y, a point F shows 0.5 atomic % of Zn and 3.5 atomic % of Y, a point G shows 0.5 atomic % of Zn and 2 atomic % of Y and a point H shows 1 atomic % of Zn and 2 atomic % of Y.

(Property of Extruded Casting Alloy of Examples 43 to 62)

Each of ingots of the Mg—Zn—Y alloys having compositions shown in Table 2 was melt using a high frequency melting furnace at an Ar gas environment and then cut into a number of chip-shaped casting products. And, after charging the chip-shaped casting products in a can made of copper, the can containing the casting product chips was subjected to a heat vacuum degasification at 150° C. and sealed. Then, the can in which the chip-shaped casting products were contained was extruded at extrusion temperatures and extrusion ratios shown in Table 2. Then, the resultant extruded materials were evaluated in a 0.2% proof strength (a yield strength), a tensile strength and an expansion by a tensile test at temperatures shown in FIG. 2. Also, a hardness (a Vickers hardness) of each of the extruded materials was evaluated. The measurements are shown in Table 2.

TABLE 2

| Mg—Zn—Y ALLOY CHIPS | | | | | | | | | | |
|---|---|---|---|---|---|---|---|---|---|---|
| | COMPOSITION (ATOMIC %) | | | EXTRUSION TEMPERA- | EXTRU-SION | TEMPERA- | 0.2% PROOF STRESS | TENSILE STRENGTH | EXPAN- | HARD-NESS |
| | Mg | Zn | Y | TURE(° C.) | RATIO | TURE(° C.) | (MPa) | (MPa) | SION(%) | (Hv) |
| EXAMPLE 43 | 97.5 | 1 | 1.5 | 350 | 10 | ROOM TEM-PERATURE | 450 | 483 | 1 | 113 |
| EXAMPLE 44 | 97.5 | 1 | 1.5 | 400 | 10 | ROOM TEM-PERATURE | 390 | 420 | 6 | 108 |
| EXAMPLE 45 | 97 | 1 | 2 | 350 | 10 | ROOM TEM-PERATURE | 442 | 464 | 5 | 105 |
| EXAMPLE 46 | 97 | 1 | 2 | 350 | 10 | 150 | 427 | 435 | 4.5 | |
| EXAMPLE 47 | 97 | 1 | 2 | 350 | 10 | 200 | 367 | 377 | 12 | |
| EXAMPLE 48 | 97 | 1 | 2 | 350 | 10 | 250 | 215 | 235 | 55 | |
| EXAMPLE 49 | 97 | 1 | 2 | 400 | 10 | ROOM TEM-PERATURE | 400 | 406 | 10 | 112 |
| EXAMPLE 50 | 96.5 | 1 | 2.5 | 350 | 10 | ROOM TEM-PERATURE | 373 | 401 | 13 | 105 |
| EXAMPLE 51 | 96.5 | 1 | 2.5 | 400 | 10 | ROOM TEM-PERATURE | 371 | 394 | 14 | 105 |
| EXAMPLE 52 | 96 | 1 | 3 | 350 | 10 | ROOM TEM-PERATURE | 400 | 424 | 6.5 | 115 |
| EXAMPLE 53 | 96 | 1 | 3 | 400 | 10 | ROOM TEM-PERATURE | 375 | 417 | 8 | 113 |
| EXAMPLE 54 | 96 | 1 | 3 | 350 | 5 | ROOM TEM-PERATURE | 440 | 452 | 0.5 | 122 |
| EXAMPLE 55 | 96 | 1 | 3 | 350 | 15 | ROOM TEM-PERATURE | 362 | 408 | 4.5 | 113 |
| EXAMPLE 56 | 97.5 | 0.5 | 2 | 350 | 10 | ROOM TEM-PERATURE | 332 | 355 | 10 | |
| EXAMPLE 57 | 97.5 | 0.5 | 2 | 400 | 10 | ROOM TEM-PERATURE | 330 | 360 | 11 | 103 |
| EXAMPLE 58 | 96.5 | 1.5 | 2 | 350 | 10 | ROOM TEM-PERATURE | 490 | 500 | 3 | |
| EXAMPLE 59 | 96.5 | 1.5 | 2 | 400 | 10 | ROOM TEM-PERATURE | 445 | 455 | 7 | 112 |
| EXAMPLE 60 | 96 | 2 | 2 | 350 | 10 | ROOM TEM-PERATURE | 497 | 500 | 4 | 114 |
| EXAMPLE 61 | 96 | 2 | 2 | 400 | 10 | ROOM TEM-PERATURE | 433 | 450 | 9 | 103 |
| EXAMPLE 62 | 93 | 3.5 | 3.5 | 350 | 10 | ROOM TEM-PERATURE | 513 | 539 | 2.3 | 103 |

Table 2 shows results of the tensile test and ha hardness test at room temperatures of the Mg—Zn—Y alloy casting materials prepared by changing addition amounts of Z and Y, to which an extrusion was subjected at a temperature and a extrusion rate shown in Table 1 and at an extrusion speed of 2.5 mm/sec for solidification.

From measurements of Examples 46 to 48, a strength at high temperatures of 200° C. is larger than that of a casting plastically worked casting alloy.

The present invention is not limited solely to the embodiments specifically exemplified above and various variations may be contained without departing from the scope of the invention.

FIG. 1 is photographs showing crystal structures of casting materials of Example 1, Comparative examples 1 and 2.

FIG. 2 is a view showing a composition range of a magnesium alloy preferably suitable for practically use.

Figure 3:
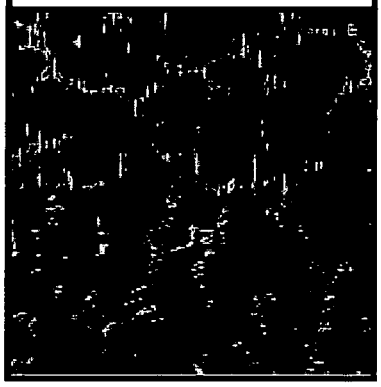
FIG. 3 is a photograph showing a crystal structure according to Example 2.

FIG. 3 is photographs showing crystal structures of casting materials of Examples 2 to 4.

Figure 4:
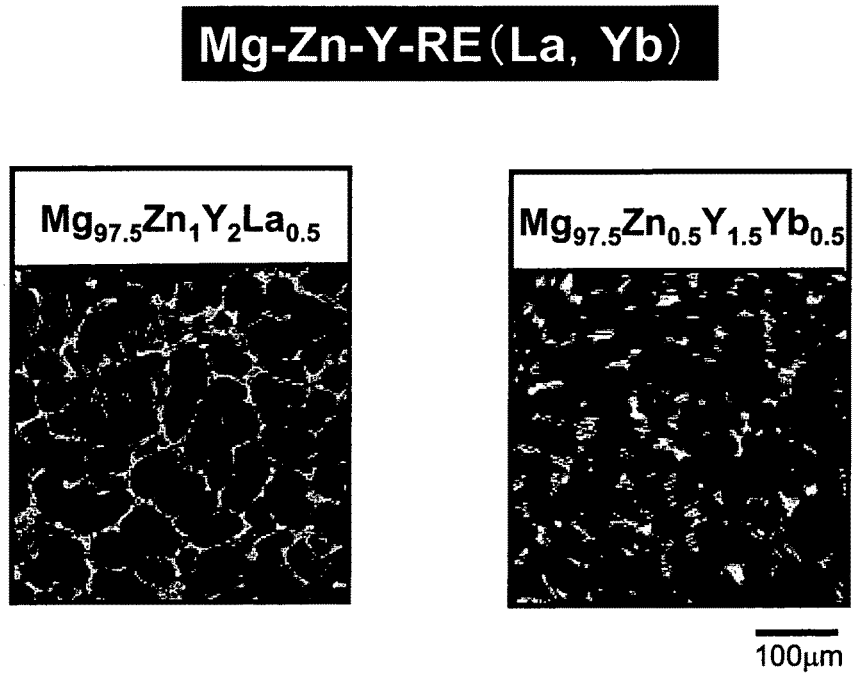
FIG. 4 is photographs showing crystal structures according to Examples 3 and 4.

FIG. 4 is photographs showing crystal structures of casting materials of Examples 5 and 6.

Figure 5:
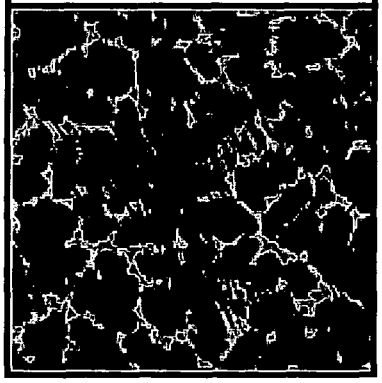
FIG. 5 is a photograph showing a crystal structure according to Example 5.

FIG. 5 is photographs showing crystal structures of casting materials of Examples 7 to 9.

FIG. 6 is photographs shoeing crystal structures of casting materials of Comparative examples 3 to 9.

FIG. 7 is a photograph shoeing crystal structures of the reference example.

Figure 8:
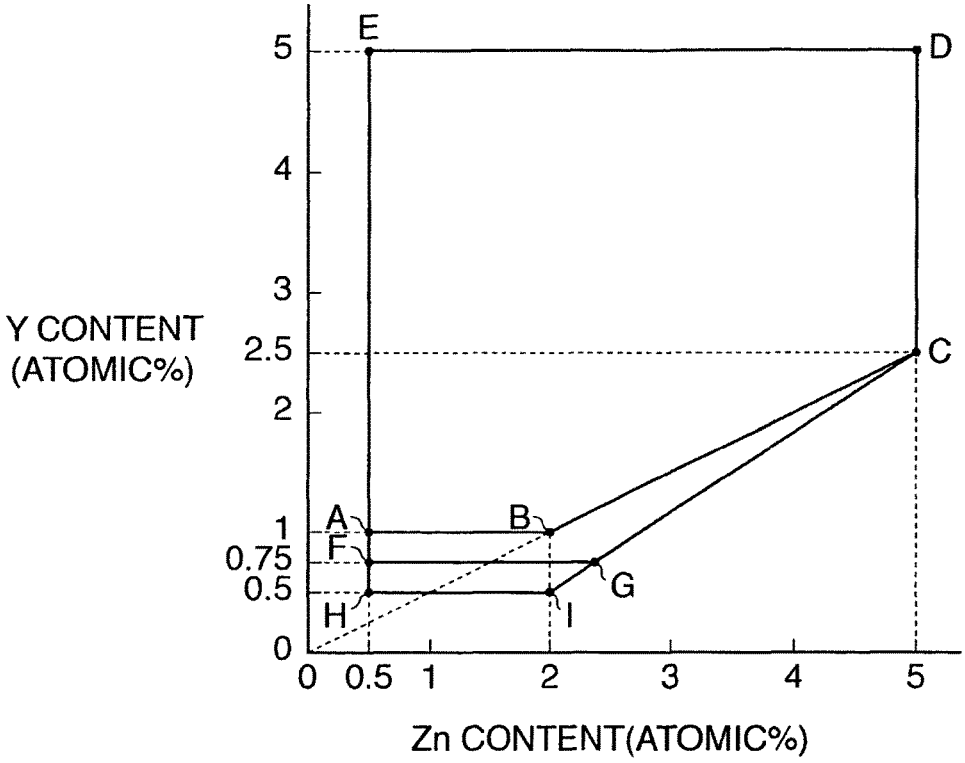

FIG. 8 is a view showing a composition range of a magnesium alloy according first embodiment of the present invention.

Figure 9:
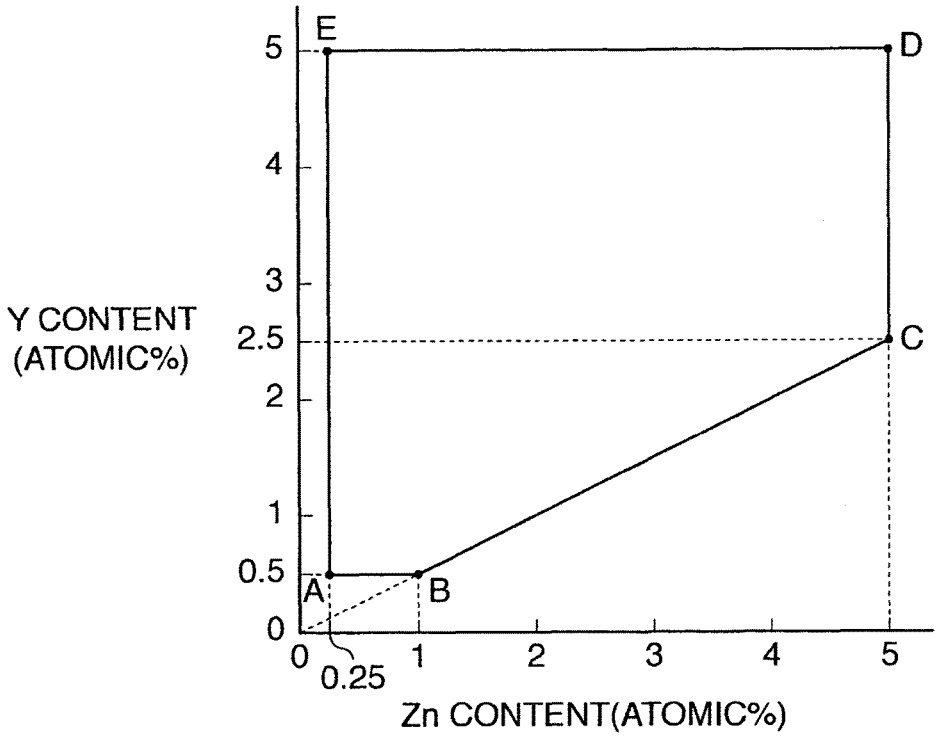

FIG. 9 is a view showing a composition range of a magnesium alloy according seventh embodiment of the present invention.

Figure 10:
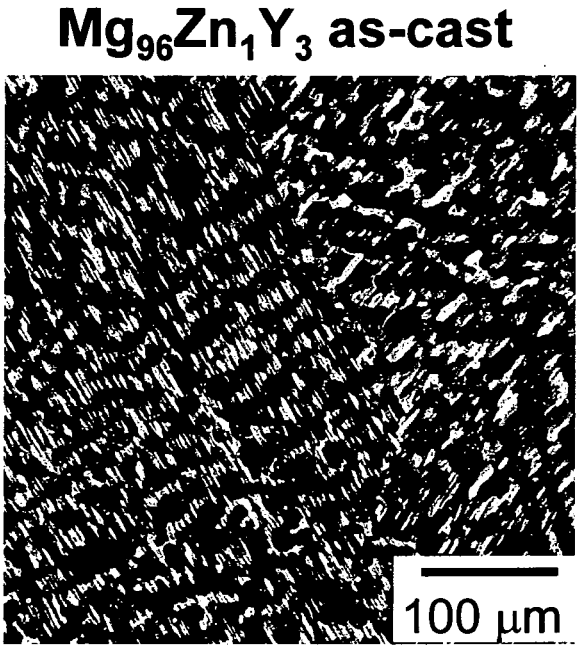
FIG. 10 is a photograph showing a crystal structure according to Example 6.

FIG. 10 is a photograph showing a crystal structure of a casting material of Example 10.

FIG. 11 is a photograph showing a crystal structure of a casting material of Example 26.

FIG. 12 is a graph showing a relationship between a number of pass of ECAE working, a yield strength (σy), a tensile strength ($\sigma_{UTS}$) and an expansion (%) of the sample of Example 1 subjected to the ECAE working at 375° C.

FIG. 13 is a graph showing a relationship between a number of pass of ECAE working, a yield strength (σy), a tensile strength ($\sigma_{UTS}$) and an expansion (%) of the sample of Example 1 subjected to the ECAE working at 400° C.

What is claimed is:

1. A method of producing a high strength and high toughness magnesium alloy comprising:

preparing a magnesium alloy casting product comprising "a" atomic % of Zn, "b" atomic % of Y and a residue of Mg, wherein "a" and "b" satisfy the following expressions (1) to (3), (1) $0.5 \leq a \leq 5.0$;

(2) $0.5 < b < 5.0$; and (3) $\frac{2}{3}a - \frac{5}{6} \leq b$, casting the magnesium alloy casting product having a cooling rate at the casting of 1000K/second or less, and producing a plastically worked product by subjecting the magnesium alloy casting product to plastic working, wherein an amount of strain per one working is 0.002 to 4.6 and a total amount of strain is 1.15 or more and 15 or less;

to obtain the high strength and high toughness magnesium alloy having a hcp structured magnesium phase, a long period stacking ordered structure phase, and at least one precipitate selected from the group consisting of a compound of Mg and rare-earth element, a compound of Mg and Zn, a compound of Zn and rare-earth element and a compound of Mg, Zn and rare-earth element.

2. The method of producing a high strength and high toughness magnesium alloy according to claim 1, wherein Mg contains larger than 0 atomic % to 2.5 atomic % or less, in a total amount, of at least one element selected from the group consisting of Al, Th, Ca, Si, Mn, Zr, Ti, Hf, Nb, Ag, Sr, Sc, B, C, Sn, Au, Ba, Ge, Bi, Ga, In, Ir, Li, Pd, Sb and V.

3. The method of producing a high strength and high toughness magnesium alloy according to claim 1, wherein the plastic working is carried out by at least one process selected from the group consisting of a rolling, a extrusion, an Equal Channel Angular Extrusion (ECAE) working, a drawing, a forging, a press, a form rolling, a bending, a Friction Stir Welding (FSW) working and a cyclic working of the workings.

4. The method of producing a high strength and high toughness magnesium alloy according to claim 1, wherein a total strain amount when the plastic working is carried out is 2.3 or more and 15 or less.

5. The method of producing a high strength and high toughness magnesium alloy according to claim 1, wherein a total strain amount when the plastic working is carried out is 4 or more and 10 or less.

6. The method of producing a high strength and high toughness magnesium alloy according to claim 1, further comprising heat-treating the plastically worked product after producing the plastically worked product.

7. The method of producing a high strength and high toughness magnesium alloy according to claim 6, wherein the heat-treating is carried out under a condition of a temperature of 200° C. to less than 500° C. and a treating period of 10 minutes to less than 24 hours.

* * * * *